US010001717B2

(12) United States Patent
Uemura et al.

(10) Patent No.: US 10,001,717 B2
(45) Date of Patent: Jun. 19, 2018

(54) ELECTROSTATIC LATENT IMAGE DEVELOPING TONER

(71) Applicant: KYOCERA Document Solutions Inc., Osaka (JP)

(72) Inventors: Hiroki Uemura, Osaka (JP); Kohei Yamauchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days. days.

(21) Appl. No.: 15/605,138

(22) Filed: May 25, 2017

(65) Prior Publication Data

US 2017/0343913 A1 Nov. 30, 2017

(30) Foreign Application Priority Data

May 30, 2016 (JP) ..... 2016-107587

(51) Int. Cl.
*G03G 9/093* (2006.01)
*G03G 9/087* (2006.01)
*G03G 9/08* (2006.01)

(52) U.S. Cl.
CPC ..... *G03G 9/09371* (2013.01); *G03G 9/0819* (2013.01); *G03G 9/0821* (2013.01); *G03G 9/0825* (2013.01); *G03G 9/08711* (2013.01); *G03G 9/08755* (2013.01); *G03G 9/09321* (2013.01); *G03G 9/09364* (2013.01); *G03G 9/09392* (2013.01)

(58) Field of Classification Search
CPC ..... G03G 9/09371; G03G 9/08755; G03G 9/0821; G03G 9/0825; G03G 9/08711; G03G 9/0819; G03G 9/09321; G03G 9/09364; G03G 9/09392
See application file for complete search history.

(56) References Cited

U.S. PATENT DOCUMENTS

| | | | |
|---|---|---|---|
| 6,656,653 | B2 | 12/2003 | Mitsuhashi et al. |
| 7,169,526 | B2 | 1/2007 | Ishikawa et al. |
| 2001/0033982 | A1 | 10/2001 | Ishikawa et al. |
| 2002/0042012 | A1 | 4/2002 | Mitsuhashi et al. |
| 2004/0146794 | A1 | 7/2004 | Mitsuhashi et al. |
| 2007/0065744 | A1 | 3/2007 | Ishikawa et al. |
| 2009/0246672 | A1 | 10/2009 | Ishikawa et al. |

FOREIGN PATENT DOCUMENTS

JP 2001-1235894 A 8/2001

*Primary Examiner* — Thorl Chea
(74) *Attorney, Agent, or Firm* — Studebaker & Brackett PC

(57) ABSTRACT

An electrostatic latent image developing toner includes a plurality of toner particles each including a composite core and a shell layer covering a surface of the composite core. The composite core is a composite of a toner core and a plurality of organic particles each adhering to a surface of the toner core. The shell layer contains a first resin having a glass transition point of at least 50° C. and no greater than 90° C. The organic particles each contain a releasing agent and a second resin having a glass transition point of at least 90° C. and no greater than 110° C.

12 Claims, 3 Drawing Sheets

ELECTROSTATIC LATENT IMAGE DEVELOPING TONER

INCORPORATION BY REFERENCE

The present application claims priority under 35 U.S.C. § 119 to Japanese Patent Application No. 2016-107587, filed on May 30, 2016. The contents of this application are incorporated herein by reference in their entirety.

BACKGROUND

The present disclosure relates to an electrostatic latent image developing toner.

The following describes a toner as an example of known toners. The toner is obtained by covering a surface of each of toner cores having an average particle diameter of 2-20 μm by a first layer of resin fine particles and a second layer of resin fine particles in order and causing these resin fine particles to adhere to or fuse with the surface of each toner core. In the above toner, the resin fine particles forming the second layer cover surfaces of the resin fine particles forming the first layer. The toner core, the resin fine particles forming the first layer, and the resin fine particles forming the second layer are caused to adhere to or fuse with one another by thermal treatment to form a single unit. The toner core contains a wax. The resin fine particles forming the first layer each contain a wax different from that contained in the toner core. The resin fine particles forming the first layer have a glass transition point of about 60° C., which is lower than that of the resin fine particles forming the second layer.

SUMMARY

An electrostatic latent image developing toner according to the present disclosure includes a plurality of toner particles each including a composite core and a shell layer covering a surface of the composite core. The composite core is a composite of a toner core and a plurality of organic particles each adhering to a surface of the toner core. The shell layer contains a first resin having a glass transition point of at least 50° C. and no greater than 90° C. The organic particles each contain a releasing agent and a second resin having a glass transition point of at least 90° C. and no greater than 110° C.

DETAILED DESCRIPTION

Figure 1:
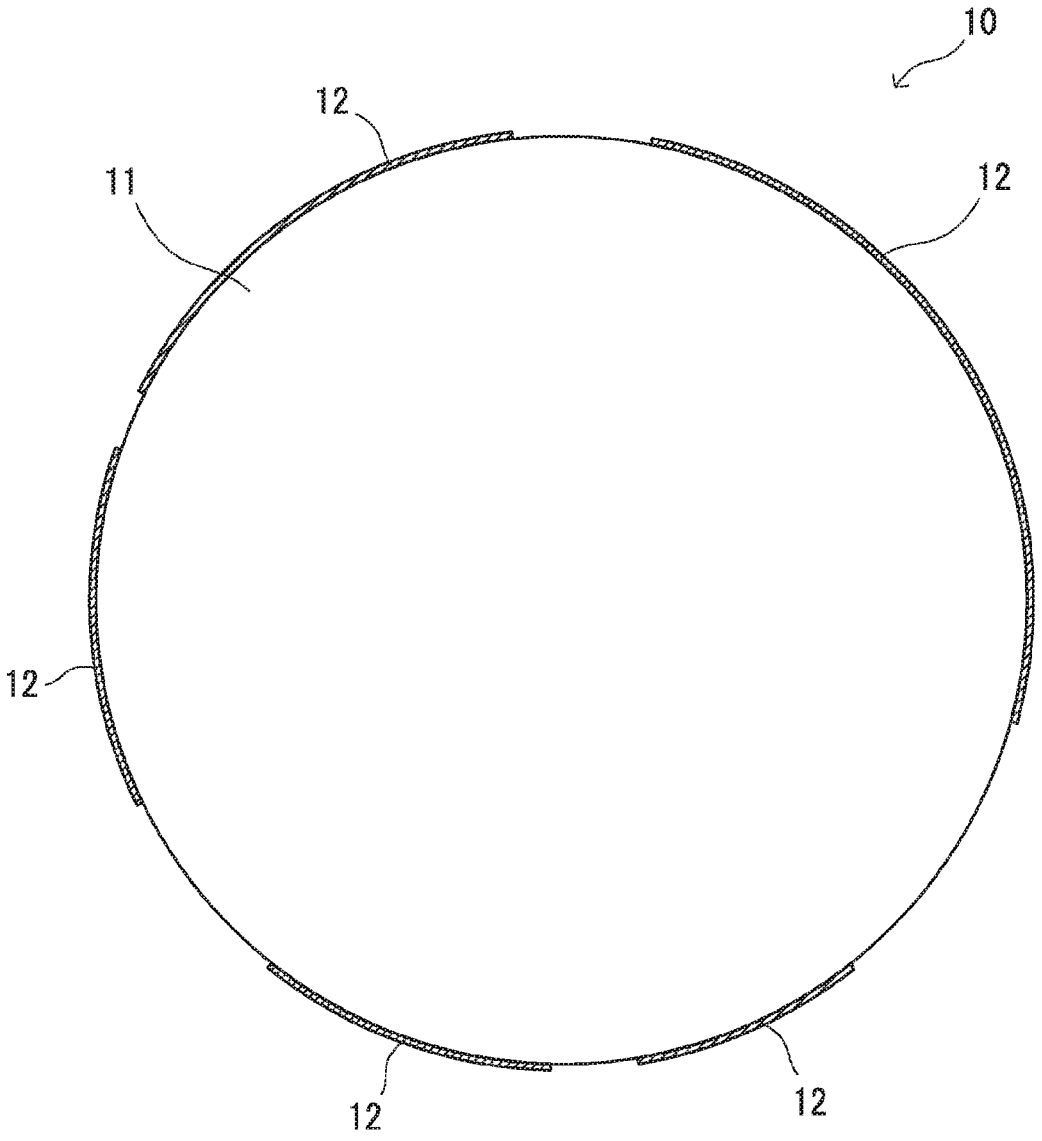
FIG. 1 is a diagram illustrating an example of a cross-section structure of a toner particle (particularly toner mother particle) included in an electrostatic latent image developing toner according to an embodiment of the present disclosure.

The following explains an embodiment of the present disclosure. Evaluation results (for example, values indicating a shape and physical properties) for a powder (specific examples include toner cores, toner mother particles, an external additive, and a toner) are each a number average of values measured for a suitable number of particles of the powder, unless otherwise stated.

A number average particle diameter of a powder is a number average value of equivalent circular diameters of primary particles of the powder (diameters of circles having the same areas as projected areas of the particles) measured using a microscope, unless otherwise stated. A value for volume median diameter ($D_{50}$) of a powder is measured based on the Coulter principle (electrical sensing zone technique) using Coulter Counter Multisizer 3 produced by Beckman Coulter, Inc., unless otherwise stated. An acid value and a hydroxyl value are measured in accordance with Japanese Industrial Standard (JIS) K0070-1992, unless otherwise stated. A glass transition point (Tg), a melting point (Mp), a softening point (Tm), and molecular weights (Mw and Mn) are measured by the same methods as those used in examples described further below or any suitable alternative method, unless otherwise stated.

In the present description, the term "-based" may be appended to the name of a chemical compound in order to form a generic name encompassing both the chemical compound itself and derivatives thereof. Also, when the term "-based" is appended to the name of a chemical compound used in the name of a polymer, the term indicates that a repeating unit of the polymer originates from the chemical compound or a derivative thereof. Furthermore, the term "(meth)acryl" is used as a generic term for both acryl and methacryl. Also, the term "(meth)acrylonitrile" is used as a generic term for both acrylonitrile and methacrylonitrile.

A toner according to the present embodiment can be favorably used for development of an electrostatic latent image. The toner according to the present embodiment is a powder including a plurality of toner particles (particles each having features described below). The toner may be used as a one-component developer. Alternatively, the toner may be mixed with a carrier using a mixer (for example, a ball mill) in order to prepare a two-component developer. In order to form a high-quality image, a ferrite carrier (a powder of ferrite particles) is preferably used as the carrier. Also, in order to form a high-quality image for an extended period of time, magnetic carrier particles each including a carrier core and a resin layer covering the carrier core are preferably used. In order to impart magnetism to carrier particles, carrier cores may be formed from a magnetic material (for example, a ferromagnetic material such as ferrite) or a resin in which magnetic particles are dispersed. Alternatively, magnetic particles may be dispersed in the resin layer covering the carrier core. The resin layer is formed from for example at least one resin selected from the group consisting of fluororesins (specific examples include PFA and FEP), polyamide-imide resins, silicone resins, urethane resins, epoxy resins, and phenolic resins. In order to form a high-quality image, an amount of the toner in the two-component developer is preferably at least 5 parts by mass and no greater than 15 parts by mass relative to 100 parts by mass of the carrier. The carrier particles preferably have a particle diameter of at least 20 μm and no greater than 120 μm, and more preferably at least 2.5 μm and no greater than 80 μm. Note that a positively chargeable toner included in a two-component developer is positively charged by friction with a carrier. Also, a negatively chargeable toner included in a two-component developer is negatively charged by friction with a carrier.

The toner according to the present embodiment can be used for image formation for example in an electrophotographic apparatus (image forming apparatus). The following describes an example of image forming methods using electrophotographic apparatuses.

Initially, an image forming section (for example, a charger and a light exposure device) of an electrophotographic apparatus forms an electrostatic latent image on a photosensitive member (for example, on a surface of a photosensitive drum) based on image data. Subsequently, a developing device (specifically, a developing device loaded with a developer including a toner) of the electrophotographic apparatus supplies the toner to the photosensitive member to develop the electrostatic latent image formed on the photosensitive member. The toner is charged by friction with a carrier, a developing sleeve, or a blade in the developing device before being supplied to the photosensitive member. For example, a positively chargeable toner is charged positively. In the developing process, the toner (specifically, the charged toner) on the developing sleeve (for example, on a surface of a development roller in the developing device) disposed in the vicinity of the photosensitive member is supplied to the photosensitive member and attached to the electrostatic latent image on the photosensitive member, whereby a toner image is formed on the photosensitive member. The developing device is replenished with toner for replenishment use from a toner container in compensation for consumed toner.

In a subsequent transfer process, a transfer device of the electrophotographic apparatus transfers the toner image on the photosensitive member to an intermediate transfer member (for example, a transfer belt) and further transfers the toner image from the intermediate transfer member to a recording medium (for example, paper). Thereafter, a fixing device (fixing method: nip fixing performed using a heating roller and a pressure roller) of the electrophotographic apparatus fixes the toner on the recording medium by applying heat and pressure to the toner. As a result, an image is formed on the recording medium. For example, a full-color image can be formed by superimposing toner images in four different colors: black, yellow, magenta, and cyan. Note that the transfer process may be a direct transfer process by which the toner image on the photosensitive member is transferred directly to the recording medium not via the intermediate transfer member. Also, a belt fixing method may be adopted as a fixing method.

The toner according to the present embodiment is an electrostatic latent image developing toner having basic features described below.

(Basic Features of Toner)

The electrostatic latent image developing toner includes a plurality of toner particles each including a composite core and a shell layer covering a surface of the composite core. The composite core is a composite of a toner core and a plurality of organic particles each adhering to a surface of the toner core. The shell layer contains a first resin having a glass transition point of at least 50° C. and no greater than 90° C. The organic particles each contain a releasing agent and a second resin having a glass transition point of at least 90° C. and no greater than 110° C. The glass transition point is measured by the same method as that used in the examples described further below or any suitable alternative method.

In a situation in which the toner core contains an excessively large amount of a releasing agent or a releasing agent is contained inside the shell layer, the releasing agent tends to precipitate on a surface of the toner particle in an environment of high temperature and high humidity, and as a consequence, adhesiveness of the toner tends to increase and/or the toner tends to become difficult to charge. Increased adhesiveness of the toner tends to cause a phenomenon in which the toner particles stick to the carrier (carrier contamination). Also, insufficient chargeability of the toner tends to cause scattering of the toner within the developing device, which may cause deterioration of image quality of a formed image.

In the toner having the above-described basic features, the releasing agent is present in the form of particles (specifically, in the organic particles) on the surface of each toner core. Furthermore, the shell layer contains the first resin having a glass transition point of at least 50° C. and no greater than 90° C., and the organic particles each contain the second resin having a glass transition point of at least 90° C. and no greater than 110° C. The organic particles having such a sufficiently high glass transition point are capable of being kept in the form of particles until fixing is performed, and easily fractured when heat and pressure are applied thereto while fixing is performed. When the organic particles are fractured, the releasing agent contained in the organic particles is supplied to the surface of each toner core. Therefore, releasability of the toner can be improved without increasing an amount of a releasing agent contained in the toner cores. Further, it is possible to prevent precipitation of a releasing agent on the surface of the toner particle in an environment of high temperature and high humidity. Therefore, sufficient chargeability of the toner can be easily ensured. Also, hot offset is prevented or reduced due to improved releasability of the toner. Therefore, a sufficient fixing operation window (fixing OW) of the toner can be easily ensured. The fixing OW refers to a width of a fixing temperature range in which offset (cold offset and hot offset) of the toner does not occur.

A toner that includes toner cores each containing a crystalline polyester resin tends to have low elasticity. Low elasticity of a toner tends to decrease a fixing OW of the toner. However, the toner having the above-described basic features has improved elasticity. Therefore, sufficient elasticity and a sufficient fixing OW of the toner can be easily ensured even when each toner core contains a crystalline polyester resin.

In order to keep the releasing agent in the organic particles until fixing is performed and supply the releasing agent from the organic particles to the surface of each toner core while fixing is performed, it is preferable that the shell layer is a film that contains a thermoplastic resin and no releasing agent is contained inside the film. In the toner including the above-described shell layer, the organic particles are present at an interface between each toner core and the shell layer. These organic particles tend to cause deformation of the shell layer to make weak regions (regions that can be fractured easily) in the shell layer. In a situation in which the shell layer has regions that can be fractured easily, sufficient low-temperature fixability of the toner can be easily ensured even when a glass transition point of the first resin contained in the shell layer is relatively high.

In the toner having the above-described basic features, the releasing agent is supplied to the surface of each toner core from the organic particles present at the interface between the toner core and the shell layer. Therefore, an amount of a releasing agent contained in the toner core canbe reduced. The amount of the releasing agent contained in the toner core may be for example at least 0.5 parts by mass and no greater than 2.5 parts by mass relative to 100 parts by mass of a binder resin. Also, when sufficient releasability of the toner is ensured, the toner core need not contain a releasing agent.

In a situation in which toner core in the above-described basic features contains a releasing agent, the toner core and the organic particles may contain the same releasing agent or respective releasing agents different from each other. In order to stabilize properties of the toner (more specifically, in order to prevent variation of the properties of the toner due to for example environmental change or passage of time), it is preferable that the toner core and the organic particles contain the same releasing agent.

The following describes an example of the toner particles (particularly toner mother particles) included in the toner having the above-described basic features with reference to FIGS. 1 to 5.

Figure 2:
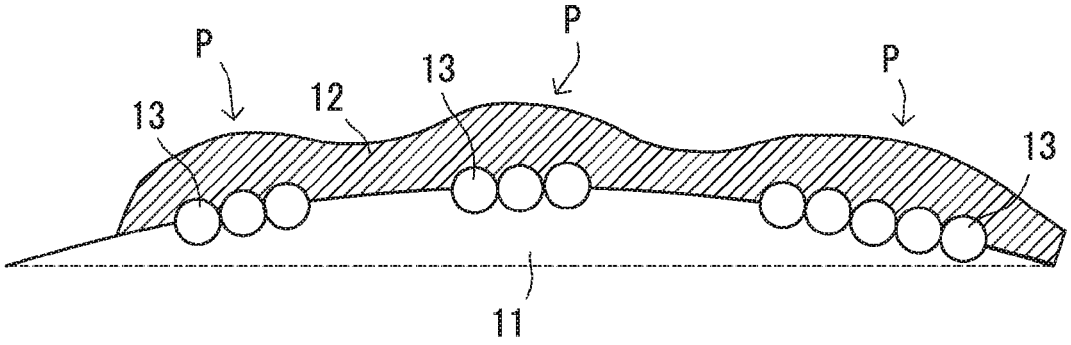
FIG. 2 is an enlarged view of a portion of a surface of the toner mother particle illustrated in FIG. 1.

A toner mother particle 10 illustrated in FIG. 1 includes a toner core 11 and a shell layer 12 partially covering a surface of the toner core 11. Note that a plurality of organic particles 13 adhere to the surface of the toner core 11 as illustrated in FIG. 2. Therefore, the plurality of organic particles 13 are each present at an interface between the toner core 11 and the shell layer 12. The plurality of organic particles 13 each contain the releasing agent and the second resin having a glass transition point of at least 90° C. and no greater than 110° C. The toner core 11 and the organic particles 13 adhering to the surface of the toner core 11 form a composite (a composite core). The shell layer 12 is a film that contains the first resin having a glass transition point of at least 50° C. and no greater than 90° C. Raised regions P are formed on a surface of the shell layer 12 at positions corresponding to the organic particles 13. Specifically, regions of the surface of the shell layer 12 under which the organic particles 13 are present are raised above other regions of the surface of the shell layer 12 under which no organic particles 13 are present.

The organic particles 13 each have the shape of for example a sphere. However, the organic particles 13 may each have any shape as long as the organic particles 13 are particles. For example, the organic particles 13 may each have the shape of a hemisphere, an ellipsoid, a semi-ellipsoid, a polyhedron (for example, an octahedron), or any other particle.

Figure 3:
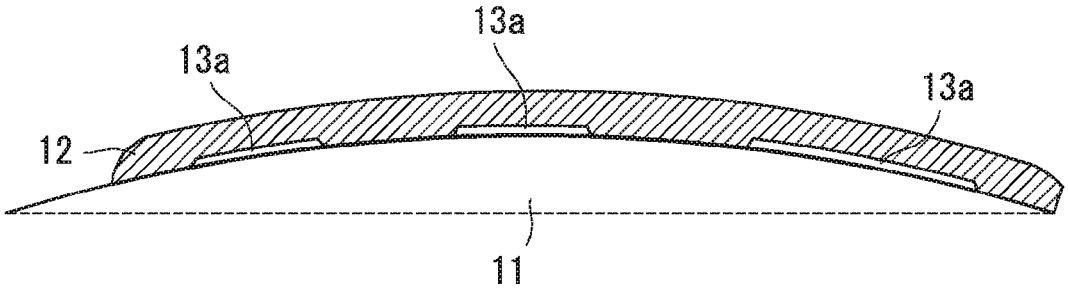
FIG. 3 RELATED ART
FIG. 3 is an enlarged view of a portion of a surface of a toner mother particle included in a toner in which a releasing agent is present in the form films on a surface of each toner core.
Figure 4:
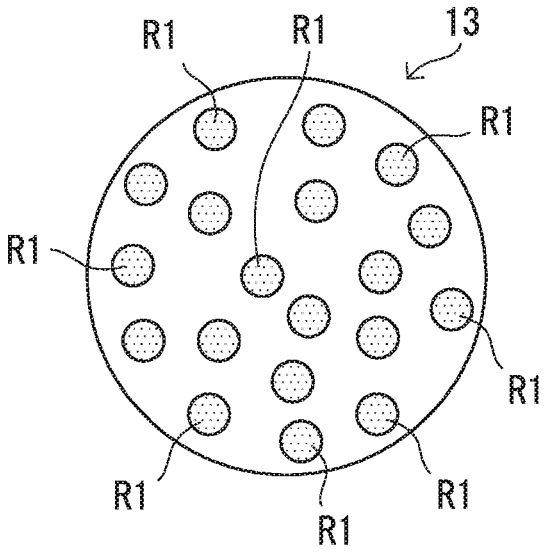
FIG. 4 is a diagram illustrating a first example of a manner in which a releasing agent is dispersed in each organic particle in the electrostatic latent image developing toner according to the embodiment of the present disclosure.
Figure 5:
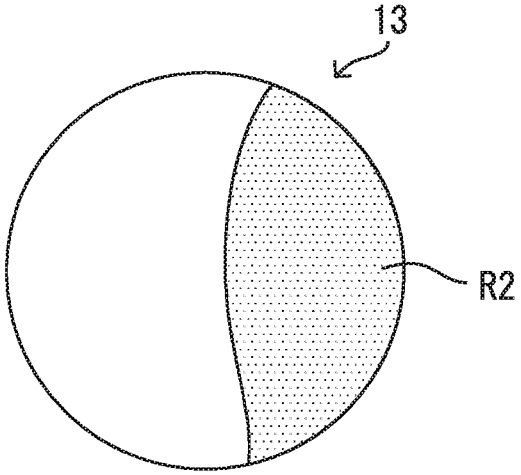
FIG. 5 is a diagram illustrating a second example of the manner in which the releasing agent is dispersed in each organic particle in the electrostatic latent image developing toner according to the embodiment of the present disclosure.

For the purpose of comparison, FIG. 3 illustrates a toner in which a releasing agent is present in the form of films (that is, not in the form of particles) on a surface of a toner core. In the example illustrated in FIG. 3, resin films 13*a* each contain the releasing agent. There are no raised regions on a surface of the shell layer 12. In the toner as illustrated in FIG. 3, the shell layer is thought to have no distinct fracture points (regions that can be fractured easily). Therefore, in a situation in which the shell layer is formed from a resin having a high glass transition point, it is difficult to ensure sufficient low-temperature fixability of the toner. Further, in a situation in which a resin has been melted to form a film, the releasing agent contained in the resin may precipitate on a surface of a toner particle, and as a consequence, adhesiveness of the toner may increase and/or the toner may become difficult to charge.

In each of the organic particles 13 illustrated in FIG. 2, the releasing agent may be dispersed in any manner. For example, the releasing agent may be dispersed all over the organic particle 13 as indicated by regions R1 in FIG. 4, or dispersed only in a part of the organic particle 13 as indicated by a region R2 in FIG. 5. The regions R1 in FIG. 4 and the region R2 in FIG. 5 indicate regions of the organic particles 13 in which the releasing agent is present.

In order to achieve both high-temperature preservability and low-temperature fixability of the toner, the shell layer preferably has a thickness of at least 20 nm and no greater than 70 nm. The thickness of the shell layer can be measured by analyzing a transmission electron microscope (TEM) image of a cross section of a toner particle using a commercially available image analysis software (for example, WinROOF produced by Mitani Corporation). In a situation in which a shell layer of a toner particle does not have a uniform thickness, thicknesses of the shell layer are measured at four positions equally spaced apart from each other (specifically, four positions at which the shell layer intersects with two orthogonal straight lines intersecting with each other at substantially the center of the cross section of the toner particle), and an arithmetic mean of the thus measured four values is determined to be an evaluation value (the thickness of the shell layer) of the toner particle. The thickness of the shell layer corresponds to a distance from the surface of the toner core to the surface of the shell layer at a point where no organic particles are present on the surface of the toner core and the shell layer is in contact with the surface of the toner core. The thickness of the shell layer corresponds to a distance from a surface of an organic particle to the surface of the shell layer at a point where the organic particle is present on the surface of the toner core and the shell layer is in contact with the surface of the organic particle. In a situation in which a boundary between the toner core and the shell layer in the TEM image is unclear, the boundary between the toner core and the shell layer can be clarified by mapping characteristic elements contained in the shell layer in the TEM image using a combination of TEM and electron energy loss spectroscopy (EELS).

The organic particles in the above-described basic features preferably have a number average primary particle diameter of for example at least 80 nm and no greater than 500 nm. When the thickness of the shell layer is at least 20 nm and no greater than 70 nm, it is particularly preferable that the organic particles have a number average primary particle diameter of at least 80 nm and no greater than 150 nm. When the thickness of the shell layer and the number average primary particle diameter of the organic particles are in the above-described respective ranges, raised regions with appropriate heights are likely to be formed on the surface of the toner mother particle.

In order to obtain a toner excellent in chargeability and fixability, an amount of the organic particles in the above-described basic features is preferably at least 0.5 parts by mass and no greater than 30 parts by mass relative to 100 parts by mass of the toner cores.

Further, in order to obtain a toner excellent in chargeability and fixability, an amount of the releasing agent contained in the organic particles in the above-described basic features is preferably at least 1% by mass and no greater than 30% by mass relative to a total mass of the organic particles.

In order to achieve both high-temperature preservability and low-temperature fixability of the toner, the shell layer preferably covers at least 50% and no greater than 100% of a surface area of each composite core. Although FIG. 1 illustrates the shell layer 12 partially covering the surface of the composite core (the composite of the toner core 11 and the plurality of organic particles 13 illustrated in FIG. 2), the shell layer may cover the entire surface area of the composite core. In the toner having the above-described basic features, the shell layer has fracture points (regions that can be easily fractured) formed by the organic particles. Therefore, sufficient low-temperature fixability of the toner can be easily ensured even in a situation in which the shell layer completely covers the entire surface area (coverage: 100%) of the composite core.

In order to achieve both high-temperature preservability and low-temperature fixability of the toner, the toner preferably has a glass transition point (Tg) (in a situation in which different glass transition points are detected, the lowest glass transition point) of at least 30° C. and no greater than 50° C. Further, in order to achieve both high-temperature preservability and low-temperature fixability of the toner, the toner preferably has a softening point (Tm) of at least 70° C. and no greater than 100° C.

In order to prevent agglomeration of the toner cores in a shell layer formation process, a triboelectric charge of the toner cores with a standard carrier is preferably smaller than 0 μC/g, and more preferably no greater than −10 μC/g. The triboelectric charge with the standard carrier is measured by the same method as that used in the examples described further below or any suitable alternative method.

In order to prevent agglomeration of the toner cores in the shell layer formation process, a zeta potential of the toner cores at pH 4 is preferably smaller than 0 mV, and more preferably no greater than −10 mV. The zeta potential at pH 4 is measured by the same method as that used in the examples described further below or any suitable alternative method.

Typically, toner cores are roughly classified into pulverized cores (also called a pulverized toner) and polymerized cores (also called a chemical toner). Toner cores obtained by a pulverization method belong to the pulverized cores, and toner cores obtained by an aggregation method belong to the polymerized cores. The toner cores in the toner having the above-described basic features are preferably pulverized cores each containing a polyester resin. In order to achieve both high-temperature preservability and low-temperature fixability of the toner, it is particularly preferable that the toner cores each contain a melt-kneaded product of a non-crystalline polyester resin, a crystalline polyester resin, and an internal additive. Further, it is preferable that the plurality of organic particles adhere to the surface of each toner core as above mainly by Van der Waals force.

In a preferable example of the toner having the above-described basic features, the toner core contains a non-crystalline polyester resin and a crystalline polyester resin, the shell layer contains the first resin described below, and the organic particles each contain the releasing agent and the second resin described below. The first resin contained in the shell layer is a polymer of at least 62% by mass and no greater than 88% by mass of a styrene-based monomer, at least 10% by mass and no greater than 33% by mass of a (meth)acrylic acid ester, and at least 2% by mass and no greater than 5% by mass of a (meth)acrylic acid. The releasing agent contained in the organic particles is at least one releasing agent selected from the group consisting of ester waxes and hydrocarbon waxes. The second resin contained in the organic particles is a polymer of at least 86% by mass and no greater than 96% by mass of a styrene-based monomer, at least 2% by mass and no greater than 7% by mass of a (meth)acrylic acid ester, and at least 2% by mass and no greater than 7% by mass of a (meth) acrylic acid.

In order to achieve both high-temperature preservability and low-temperature fixability of the toner, the toner cores preferably have a volume median diameter ($D_{50}$) of at least 4 μm and no greater than 9 μm.

The following describes preferable features of each toner particle. The toner core contains a binder resin. The toner core may contain an internal additive (for example, at least one of a releasing agent, a colorant, a charge control agent, and a magnetic powder) as necessary in addition to the binder resin. The shell layer is substantially formed from a resin. Both high-temperature preservability and low-temperature fixability of the toner can be achieved by covering each toner core that melts at a low temperature with a shell layer excellent in heat resistance. An additive may be dispersed in the resin forming the shell layer. The shell layer may cover the entire surface area of each composite core or partially cover the surface of each composite core.

The shell layer may be a film with no granular appearance, or a film with granular appearance. In a situation in which resin particles are used as a material for forming the shell layer, if the material (resin particles) has been completely melted before curing in the form of a film, the resultant shell layer is probably formed as a film with no granular appearance. By contrast, if the material (resin particles) has not been completely melted before curing in the form a film, the resultant shell layer is probably formed as a film in which the resin particles are two-dimensionally arranged (namely, a film with granular appearance). Resin particles can be melted to form a film for example by attaching the resin particles to the surface of each composite core in a liquid and heating the liquid. However, resin particles may be formed into a film by being heated in a drying process or receiving physical impact force in an external addition process. All part of the shell layer is not necessarily formed integrally. The shell layer may be a single film, or an aggregate of a plurality of film fragments (islands) separate from one another.

The toner particle may include an external additive. In a configuration in which the toner particle includes an external additive, the toner particle includes the toner mother particle and the external additive. The external additive is attached to a surface of the toner mother particle. The toner mother particle in the toner having the above-described basic features includes the composite core (the toner core and the organic particles) and the shell layer. In a configuration in which the external additive is omitted, the toner mother particle is equivalent to the toner particle. A material for forming the shell layer will be referred to below as a shell material.

Resins listed below can be preferably used for forming the toner particle.

<Preferable Thermoplastic Resins>

Examples of thermoplastic resins that can be preferably used include styrene-based resins, acrylic acid-based resins (specific examples include acrylic acid ester polymers and methacrylic acid ester polymers), olefin-based resins (specific examples include polyethylene resins and polypropylene resins), vinyl chloride resins, polyvinyl alcohols, vinyl ether resins, N-vinyl resins, polyester resins, polyamide resins, and urethane resins. Also, copolymers of the above resins, that is, copolymers obtained by incorporation of a repeating unit into any of the above resins (specific examples include styrene-acrylic acid-based resins and styrene-butadiene-based resins) may be used.

A thermoplastic resin is obtained by addition polymerization, copolymerization, or condensation polymerization of at least one thermoplastic monomer. A thermoplastic monomer is a monomer that forms a thermoplastic resin by homopolymerization (specific examples include acrylic acid-based monomers and styrene-based monomers) or a monomer that forms a thermoplastic resin by condensation polymerization (for example, a polyester resin is formed by condensation polymerization of a polyhydric alcohol and a polybasic carboxylic acid).

A styrene-acrylic acid-based resin is a copolymer of at least one styrene-based monomer and at least one acrylic acid-based monomer. Examples of styrene-based monomers and acrylic acid-based monomers that can be preferably used in synthesis of a styrene-acrylic acid-based resin are listed below. A styrene-acrylic acid-based resin having a carboxyl group can be obtained by using an acrylic acid-based monomer having the carboxyl group. Also, a styrene-acrylic acid-based resin having a hydroxyl group can be obtained by using a monomer having the hydroxyl group (specific examples include p-hydroxystyrene, m-hydroxystyrene, and (meth)acrylic acid hydroxyalkyl esters).

Examples of styrene-based monomers that can be preferably used include styrene, alkylstyrenes (specific examples include α-methylstyrene, p-ethylstyrene, and 4-tert-butylstyrene), p-hydroxystyrene, m-hydroxystyrene, vinyltoluene, α-chlorostyrene, o-chlorostyrene, m-chlorostyrene, and p-chlorostyrene.

Examples of acrylic acid-based monomers that can be preferably used include (meth)acrylic acid, (meth)acrylonitrile, (meth)acrylic acid alkyl esters, and (meth)acrylic acid hydroxyalkyl esters. Examples of preferable (meth)acrylic acid alkyl esters include methyl (meth)acrylate, ethyl (meth) acrylate, n-propyl (meth)acrylate, iso-propyl (meth)acrylate, n-butyl (meth)acrylate, iso-butyl (meth)acrylate, and 2-ethylhexyl (meth)acrylate. Examples of preferable (meth) acrylic acid hydroxyalkyl esters include 2-hydroxyethyl (meth)acrylate, 3-hydroxypropyl (meth)acrylate, 2-hydroxypropyl (meth)acrylate, and 4-hydroxybutyl (meth) acrylate.

A polyester resin can be obtained by condensation polymerization of at least one polyhydric alcohol and at least one polybasic carboxylic acid. Examples of alcohols that can be preferably used in synthesis of a polyester resin include dihydric alcohols (specific examples include diols and bisphenols) and tri- or higher-hydric alcohols listed below. Examples of carboxylic acids that can be preferably used in synthesis of a polyester resin include dibasic carboxylic acids and tri- or higher-basic carboxylic acids listed below.

Examples of preferable diols include ethylene glycol, diethylene glycol, triethylene glycol, neopentyl glycol, 1,2-propanediol, α,ω-alkanediols (specific examples include ethylene glycol, 1,3-propanediol, 1,4-butanediol, 1,5-pentanediol, 1,6-hexanediol, 1,7-heptanediol, 1,8-octanediol, 1,9-nonanediol, and 1,12-dodecandiol), 2-butene-1,4-diol, 1,4-cyclohexanedimethanol, dipropylene glycol, polyethylene glycol, polypropylene glycol, and polytetramethylene glycol.

Examples of preferable bisphenols include bisphenol A, hydrogenated bisphenol A, bisphenol A ethylene oxide adduct, and bisphenol A propylene oxide adduct.

Examples of preferable tri- or higher-hydric alcohols include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Examples of preferable dibasic carboxylic acids include aromatic dicarboxylic acids (specific examples include phthalic acid, terephthalic acid, and isophthalic acid), α,ω-alkane dicarboxylic acids (specific examples include malonic acid, succinic acid, adipic acid, suberic acid, azelaic acid, sebacic acid, and 1,10-decanedicarboxylic acid), alkyl succinic acids (specific examples include n-butylsuccinic acid, isobutylsuccinic acid, n-octylsuccinic acid, n-dodecylsuccinic acid, and isododecylsuccinic acid), alkenyl succinic acids (specific examples include n-butenylsuccinic acid, isobutenylsuccinic acid, n-octenylsuccinic acid, n-dodecenylsuccinic acid, and isododecenylsuccinic acid), unsaturated dicarboxylic acids (specific examples include maleic acid, fumaric acid, citraconic acid, itaconic acid, and glutaconic acid), and cycloalkanedicarboxylic acids (specific examples include cyclohexanedicarboxylic acid).

Examples of preferable tri- or higher-basic carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

[Toner Core]

(Binder Resin)

The binder resin is typically a main component (for example, at least 85% by mass) of the toner core. Properties of the binder resin are therefore thought to have a great influence on properties of the toner core as a whole. Properties (specific examples include a hydroxyl value, an acid value, a glass transition point (Tg), and a softening point (Tm)) of the binder resin can be adjusted by using a combination of a plurality of resins as the binder resin. In a situation in which the binder resin has an ester group, a hydroxyl group, an ether group, an acid group, or a methyl group, the toner core is highly likely to be anionic. In a situation in which the binder resin has an amino group or an amide group, the toner core is highly likely to be cationic. In order to ensure sufficient fixability of the toner in high speed fixing, a glass transition point (Tg) of the binder resin (in a situation in which the toner core contains a plurality of resins as the binder resin, a resin that makes up a largest proportion of the binder resin) is preferably at least 30° C. and no greater than 60° C., and more preferably at least 35° C. and no greater than 55° C. Also, in order to ensure sufficient fixability of the toner in high speed fixing, a softening point (Tm) of the binder resin (in a situation in which the toner core contains a plurality of resins as the binder resin, a resin that makes up a largest proportion of the binder resin) is preferably at least 60° C. and no greater than 150° C., and more preferably at least 70° C. and no greater than 140° C.

In order to achieve both high-temperature preservability and low-temperature fixability of the toner, the toner core preferably contains a crystalline polyester resin and a non-crystalline polyester resin. A toner core containing a crystalline polyester resin has sharp meltability.

In order to achieve both high-temperature preservability and low-temperature fixability of the toner, an amount of the crystalline polyester resin contained in the toner cores is preferably at least 1% by mass and no greater than 50% by mass, and more preferably at least 15% by mass and no greater than 25% by mass relative to a total amort of the polyester resins (the crystalline polyester resin and the non-crystalline polyester resin) contained in the toner cores. For example, when the total amount of the polyester resins contained in the toner cores is 100 g, the amount of the crystalline polyester resin contained in the toner cores is preferably at least 1 g and no greater than 50 g (more preferably, at least 15 g and no greater than 25 g).

In order that the toner core has a desired degree of sharp meltability, the toner core preferably contains a crystalline polyester resin having a crystallinity index of at least 0.90 and smaller than 1.15. A crystallinity index of a resin is a ratio (Tm/Mp) of a softening point (Tm) of the resin to a melting point (Mp) of the resin. A definite melting point (Mp) of a non-crystalline polyester resin is often unmeasurable. A melting point (Mp) and a softening point (Tm) of a resin are measured by the same methods as those used in the examples described further below or any suitable alternative method. A crystallinity index of a crystalline polyester resin can be adjusted by changing a material (for example, an alcohol or a carboxylic acid) used in synthesis of the crystalline polyester resin or an amount of use of the material. The toner core may contain only one crystalline polyester resin, or at least two crystalline polyester resins.

In order to achieve both high-temperature preservability and low-temperature fixability of the toner, it is particularly preferable that the toner core contains a crystalline polyester resin having a melting point (Mp) of at least 50° C. and no greater than 100° C.

In order to ensure sufficient crystallinity of the crystalline polyester resin, the crystalline polyester resin contains, as an alcohol component, preferably an aliphatic diol having a carbon number of at least 2 and no greater than 8, and more preferably an α,ω-alkanediol having a carbon number of at least 2 and no greater than 8 (specific examples include 1,6-hexanediol having a carbon number of 6). Further, in order to ensure sufficient crystallinity of the crystalline polyester resin, an alcohol component (a single component) that makes up a largest proportion of all alcohol component(s) of the crystalline polyester resin accounts for preferably at least 70 mol %, more preferably at least 90 mol %, and particularly preferably 100 mol % of all the alcohol component(s). In order to ensure sufficient crystallinity of the crystalline polyester resin, an aliphatic diol having a carbon number of at least 2 and no greater than 8 accounts for preferably at least 80 mol %, and more preferably at least 90 mol % of all the alcohol component(s) of the crystalline polyester resin.

In order to ensure sufficient crystallinity of the crystalline polyester resin, the crystalline polyester resin contains, as an acid component, preferably an aliphatic dicarboxylic acid having a carbon number of at least 4 and no greater than 16, and more preferably an α,ω-alkane dicarboxylic acid having a carbon number of at least 4 and no greater than 16 (specific examples include 1,10-decanedicarboxylic acid having a carbon number of 12). Further, in order to ensure sufficient crystallinity of the crystalline polyester resin, an acid component (a single component) that makes up a largest proportion of all acid component(s) of the crystalline polyester resin accounts for preferably at least 70 mol %, more preferably at least 90 mol %, and particularly preferably 100 mol % of all the acid component(s). In order to ensure sufficient crystallinity of the crystalline polyester resin, an aliphatic dicarboxylic acid having a carbon number of at least 4 and no greater than 16 accounts for preferably at least 80 mol %, and more preferably 90 mol % of all the acid component(s) of the crystalline polyester resin.

In order that the toner core has a desired degree of sharp meltability, the toner core preferably contains a crystalline polyester resin that contains, as an alcohol component, an α,ω-alkanediol having a carbon number of at least 2 and no greater than 8 and, as an acid component, an α,ω-alkane dicarboxylic acid having a carbon number of at least 4 and no greater than 16. In order to compatibilize the above crystalline polyester resin with a non-crystalline polyester resin in the toner core to a desired extent, the toner core preferably contains, as the non-crystalline polyester resin, a polymer of monomers (resin raw materials) including at least one bisphenol (specific examples include bisphenol A ethylene oxide adduct and bisphenol A propylene oxide adduct), at least one dibasic carboxylic acid (specific examples include a fumaric acid), and at least one tri- or higher-basic carboxylic acid (specific examples include a trimellitic acid). The non-crystalline polyester resin contained in the toner core preferably has an acid value of at least 5 mgKOH/g and no greater than 30 mgKOH/g and a hydroxyl value of at least 15 mgKOH/g and no greater than 80 mgKOH/g. In order to ensure sufficient fixability of the toner, the toner core preferably contains a non-crystalline polyester resin having a mass average molecular weight (Mw) of at least 10000 and no greater than 50000 and a molecular weight distribution (a ratio (Mw/Mn) of the mass average molecular weight (Mw) to a number average molecular weight (Mn)) of at least 8 and no greater than 50. In a situation in which the mass average molecular weight (Mw) or the molecular weight distribution (Mw/Mn) of the non-crystalline polyester resin is excessively large, hot offset is likely to occur. In a situation in which the mass average molecular weight (Mw) or the molecular weight distribution (Mw/Mn) of the non-crystalline polyester resin is excessively small, it is difficult to surely fix the toner at a low temperature.

The toner core may contain, as the binder resin, a resin other than the polyester resins. Examples of resins that can be preferably used as the binder resin other than the polyester resins include thermoplastic resins such as styrene-based resins, acrylic acid-based resins (specific examples include acrylic acid ester polymers and methacrylic acid ester polymers), olefin-based resins (specific examples include polyethylene resins and polypropylene resins), vinyl chloride resins, polyvinyl alcohols, vinyl ether resins, N-vinyl resins, polyamide resins, and urethane resins. Also, copolymers of the above resins, that is, copolymers obtained by incorporation of a repeating unit into any of the above resins (specific examples include styrene-acrylic acid-based resins and styrene-butadiene-based resins) can be preferably used as the binder resin.

(Colorant)

The toner core may contain a colorant. A known pigment or dye that matches the color of the toner can be used as the colorant. The colorant is preferably contained in an amount of at least 1 part by mass and no greater than 20 parts by mass relative to 100 parts by mass of the binder resin.

The toner core may contain a black colorant. An example of the black colorant is carbon black. Alternatively, the black colorant may be a colorant that is adjusted to a black color using a yellow colorant, a magenta colorant, and a cyan colorant. A magnetic powder described further below may be used as the black colorant.

The toner core may contain a non-black colorant such as a yellow colorant, a magenta colorant, or a cyan colorant.

The yellow colorant that can be used is for example one or more compounds selected from the group consisting of condensed azo compounds, isoindolinone compounds, anthraquinone compounds, azo metal complexes, methine compounds, and arylamide compounds. Examples of yellow colorants that can be preferably used include C. I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, and 194), Naphthol Yellow S, Hansa Yellow G, and C. I. Vat Yellow.

The magenta colorant that can be used is for example one or more compounds selected from the group consisting of condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Examples of magenta colorants that can be preferably used include C.I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, and 254).

The cyan colorant that can be used is for example one or more compounds selected from the group consisting of copper phthalocyanine compounds, anthraquinone compounds, and basic dye lake compounds. Examples of cyan colorants that can be preferably used include C.I. Pigment Blue (1, 7, 15, 15:1, 15:2, 15:3, 15:4, 60, 62, and 66), Phthalocyanine Blue, C.I. Vat Blue, and C.I. Acid Blue.

(Releasing Agent)

The toner core may contain a releasing agent. The releasing agent is used for example in order to improve fixability of the toner or resistance of the toner to being offset.

Examples of releasing agents that can be preferably used as the releasing agent contained in the toner core include: aliphatic hydrocarbon waxes such as low molecular weight polyethylene, low molecular weight polypropylene, polyolefin copolymer, polyolefin wax, microcrystalline wax, paraffin wax, and Fischer-Tropsch wax; oxides of aliphatic hydrocarbon waxes such as polyethylene oxide wax and block copolymer of polyethylene oxide wax; plant waxes such as candelilla wax, carnauba wax, Japan wax, jojoba wax, and rice wax; animal waxes such as beeswax, lanolin, and spermaceti; mineral waxes such as ozokerite, ceresin, and petrolatum; waxes having a fatty acid ester as a main component such as montanic acid ester wax and castor wax; and waxes in which a part or all of a fatty acid ester has been deoxidized such as deoxidized carnauba wax. A synthetic ester wax is particularly preferably used as the releasing agent contained in the toner core. One releasing agent may be used alone, or two or more releasing agents may be used in combination.

(Charge Control Agent)

The toner core may contain a charge control agent. The charge control agent is used for example in order to improve charge stability or a charge rise characteristic of the toner. The charge rise characteristic of the toner is an indicator as to whether the toner can be charged to a specific charge level in a short period of time.

Anionic strength of the toner core can be increased by including a negatively chargeable charge control agent (specific examples include organic metal complexes and chelate compounds) in the toner core. Cationic strength of the toner core can be increased by including a positively chargeable charge control agent (specific examples include pyridine, nigrosine, and quaternary ammonium salts) in the toner core. However, when sufficient chargeability of the toner is ensured, the toner core need not contain a charge control agent.

(Magnetic Powder)

The toner core may contain a magnetic powder. Examples of materials of the magnetic powder that can be preferably used include ferromagnetic metals (specific examples include iron, cobalt, and nickel), alloys of the ferromagnetic metals, ferromagnetic metal oxides (specific examples include ferrite, magnetite, and chromium dioxide), and materials subjected to ferromagnetization (specific examples include carbon materials to which ferromagnetism is imparted through thermal treatment) One magnetic powder may be used alone, or two or more magnetic powders may be used in combination.

In order to impart sufficient magnetism uniformly to the toner core, the magnetic powder preferably has a particle diameter of at least 0.1 μm and no greater than 1.0 μm, and more preferably at least 0.1 μm and no greater than 0.5 μm. In order to inhibit elution of metal ions (for example, iron ions) from the magnetic powder, surface treatment is preferably performed on the magnetic powder (specifically, a surface of each magnetic particle included in the magnetic powder) using a surface treatment agent (specific examples include silane coupling agents and titanate coupling agents).

[Organic Particles]

In the toner having the above-described basic features, the plurality of organic particles adhere to the surface of each toner core. The organic particles each contain the releasing agent and the second resin having a glass transition point of at least 90° C. and no greater than 110° C.

The second resin contained in the organic particles is preferably one of the "Preferable Thermoplastic Resins" listed above, more preferably at least one resin selected from the group consisting of acrylic acid-based resins, polyvinyl alcohols, urethane resins, polyester resins, and copolymers of the aforementioned resins (specific examples include styrene-acrylic acid-based resins, silicone-acrylic acid-based graft copolymers, and ethylene-vinylalcohol copolymers), and particularly preferably a styrene-acrylic acid-based resin. The styrene-acrylic acid-based resin is particularly preferably a polymer of monomers (resin raw materials) including at least one styrene-based monomer, at least one meth)acrylic acid ester, and at least one (meth) acrylic acid. In a situation in which a (meth)acrylic acid is used in synthesis of the second resin, the second resin has a carboxyl group.

The releasing agent contained in the organic particles is preferably at least one releasing agent selected from the group consisting of ester waxes (specific examples include synthetic ester waxes and natural ester waxes) and hydrocarbon waxes, and particularly preferably a synthetic ester wax. In a situation in which a synthetic ester wax is used as the releasing agent, a melting point of the releasing agent can be easily adjusted within a desired range. A commercially available synthetic ester wax may be used. Alternatively, a synthetic ester wax may be prepared by reacting an alcohol and a carboxylic acid (or a carboxylic acid halide) with each other in the presence of an acid catalyst. A long-chain fatty acid originated from a natural oil may be used as a raw material of the synthetic ester wax. Examples of preferable natural ester waxes include carnauba wax and rice wax.

In order to improve fixability of the toner, the releasing agent contained in the organic particles preferably has a melting point (Nip) of at least 50° C. and no greater than 100° C.

[Shell Layer]

In the toner having the above-described basic features, the toner core and the organic particles adhering to the surface of the toner core form a composite (composite core). The shell layer covers the surface of the composite core. The shell layer contains the first resin having a glass transition point of at least 50° C. and no greater than 90° C.

The first resin contained in the shell layer is preferably one of the "Preferable Thermoplastic Resins" listed above, more preferably at least one resin selected from the group consisting of acrylic acid-based resins, polyvinyl alcohols, urethane resins, polyester resins, and copolymers of the aforementioned resins (specific examples include styrene-acrylic acid-based resins, silicone-acrylic acid-based graft copolymers, and ethylene-vinylalcohol copolymers), and particularly preferably a styrene-acrylic acid-based resin. The styrene-acrylic acid-based resin is particularly preferably a polymer of monomers (resin raw materials) including at least one styrene-based monomer, at least one (meth) acrylic acid ester, and at least one (meth)acrylic acid. In a situation in which a (meth)acrylic acid is used in synthesis of the first resin, the first resin has a carboxyl group.

[External Additive]

An external additive (specifically, a powder including a plurality of external additive particles) may be caused to adhere to the surface of each toner mother particle. Unlike an internal additive, the external additive is not present inside the toner mother particle and is selectively present only on the surface of the toner mother particle (in a surface layer portion of the toner particle). The external additive adheres to the surface of each toner mother particle for example when the toner mother particles (powder) and the external additive (powder) are stirred together. The toner mother particle does not chemically react with the external additive particles. The toner mother particle and the external additive particles bond together physically not chemically. Bonding strength between the toner mother particle and the external additive particles can be adjusted by controlling conditions of stirring (more specifically, a stirring time, a rotational speed for stirring, and the like) and a particle size, shape, and surface conditions of the external additive particles.

In order to make the external additive sufficiently exhibit its function while preventing separation of the external additive particles from the toner particle, an amount of the external additive is preferably at least 0.5 parts by mass and no greater than 10 parts by mass relative to 100 parts by mass of the toner mother particles.

The external additive particles are preferably inorganic particles, and particularly preferably silica particles or particles of metal oxides (specific examples include alumina, titanium oxide, magnesium oxide, zinc oxide, strontium titanate, and barium titanate). Particles of organic acid compounds such as fatty acid metal salts (specific examples include zinc stearate) and resin particles may also be used as the external additive particles. Surface treatment may be performed on the external additive particles. One type of the external additive particles may be used alone, or two or more types of the external additive particles may be used in combination.

In order to improve fluidity of the toner, inorganic particles (powder) having a number average primary particle diameter of at least 5 nm and no greater than 30 nm are preferably used as the external additive particles. In order to improve high-temperature preservability of the toner by making the external additive function as a spacer between the toner particles, it is preferable to use, as the external additive particles, resin particles (powder) having a number average primary particle diameter of at least 50 nm and no greater than 200 nm.

[Method for Producing Toner]

The toner having the above-described basic features can be produced easily and favorably for example by the following method including a toner core preparation process, a core external addition process, and a shell layer formation process.

(Toner Core Preparation Process)

Preferable examples of methods for forming toner cores include the pulverization method and the aggregation method. Sufficient dispersion of an internal additive in a binder resin can be easily achieved by these methods.

In an example of the pulverization method, a binder resin, a colorant, a charge control agent, and a releasing agent are initially mixed. Then, the resultant mixture is melt-kneaded using a melt-kneading device (for example, a single-screw or twin-screw extruder). Then, the resultant melt-kneaded product is pulverized, and the resultant pulverized product is classified. Through the above, toner cores are obtained. The pulverization method is usually a more easy method for preparing toner cores than the aggregation method.

In an example of the aggregation method, a binder resin, a releasing agent, and a colorant each in the form of fine particles are initially caused to aggregate in an aqueous medium to form particles having a desired particle diameter. Through the above, aggregated particles containing components of the binder resin, the releasing agent, and the colorant are formed. Subsequently, the aggregated particles are heated to cause coalescence of the components contained in the aggregated particles. As a result, toner cores having a desired particle diameter are obtained.

(Core External Addition Process)

Organic particles (for example, thermoplastic resin particles each containing a releasing agent) are fixed to the surface of each toner core for example by mixing the toner cores and the organic particles using a mixer (specific examples include an FM mixer produced by Nippon Coke & Engineering Co., Ltd. and a Nauta mixer (registered Japanese trademark) produced by Hosokawa Micron Corporation) under such conditions that the organic particles are not embedded in the toner cores. When the toner cores and the organic particles are stirred together, the organic particles adhere to the surface of each toner core by physical force (physical connection). As a result, a composite core (composite of the toner core and the organic particles) is obtained. The organic particles adhere to the surface of each toner core for example mainly by Van der Waals force.

For example, the FM mixer (produced by Nippon Coke & Engineering Co., Ltd.) can be used as the above-described mixer. The FM mixer includes a mixing vessel equipped with a temperature control jacket. The FM mixer further includes a deflector, a temperature sensor, an upper screw, and a lower screw, which are provided in the mixing vessel. When materials (more specifically, powders or slurry) loaded into the mixing vessel of the FM mixer are mixed, the materials in the mixing vessel are caused to flow in an up-and-down direction while swirling by rotation of the lower screw. As a result, a convective flow of the materials is generated in the mixing vessel. Shear force is applied to the materials by the upper screw rotating at a high speed. The FM mixer is capable of mixing the materials with strong mixing force by applying the shear force to the materials.

(Shell Layer Formation Process)

A shell layer is formed on the surface of each composite core obtained as above. The following describes a preferable example of methods for forming the shell layer. In order to inhibit dissolution or elution of toner core components (particularly, the binder resin and the releasing agent) during formation of the shell layer, the shell layer is preferably formed in an aqueous medium. The aqueous medium is a medium of which a main component is water (specific examples include pure water and a liquid mixture of water and a polar medium). The aqueous medium may function as a solvent. A solute may be dissolved in the aqueous medium. The aqueous medium may function as a dispersion medium. A dispersoid may be dispersed in the aqueous medium. Examples of polar mediums that can be used in the aqueous medium include alcohols (specific examples include methanol and ethanol). The aqueous medium has a boiling point of about 100° C.

Initially, a weakly acid aqueous medium (having a pH within a range for example from 3 to 5) is prepared by adding a hydrochloric acid to ion exchanged water. Then, a shell material (for example, thermoplastic resin particles containing no releasing agent) is added to the aqueous medium after pH adjustment.

Note that an amount of the shell material appropriate to form the shell material with a desired thickness can be calculated based on for example a specific surface area of the composite core. Also, a polymerization accelerator may be added to the liquid.

In order to uniformly attach the shell material to the surface of each composite core, it is preferable to achieve a high degree of dispersion of the composite cores in the liquid containing the shell material. In order to achieve a high degree of dispersion of the composite cores in the liquid, a surfactant may be added to the liquid or the liquid may be stirred using a powerful stirrer (for example, Hivis Disper Mix produced by PRIMIX Corporation). In a situation in which the composite cores are anionic, agglomeration of the composite cores can be prevented by using an anionic surfactant having the same polarity. Examples of surfactants that can be used include sulfate ester salt surfactants, sulfonic acid salt surfactants, phosphate acid ester salt surfactants, and soaps.

Subsequently, a temperature of the liquid containing the composite cores and the shell material is increased up to a predetermined retention temperature (for example, at least 40° C. and no greater than 95° C.) at a predetermined rate (for example, at least 0.1° C./min and no greater than 3.0° C./min) while the liquid is stirred. A retention temperature of at least 50° C. and no greater than 90° C. is particularly preferable in order that formation of the shell layer proceeds favorably. The temperature of the liquid is maintained at the retention temperature for a predetermined time period (for example, at least 30 minutes and no greater than 4 hours) while the liquid is stirred. Bonding between the composite core and the shell material (solidification of the shell layer) is thought to proceed while the liquid is maintained at a high temperature (or while the liquid is heated). In a situation in which the shell material (resin particles) has been melted (or deformed) by being heated in the liquid, a shell layer in the form of a film (specifically, a cured resin film) is probably formed on the surface of each composite core. By contrast, in a situation in which the shell material (resin particles) has not been sufficiently deformed by being heated, a shell layer in the form of particles (an aggregate of the resin particles) probably cover the surface of each composite core. When the shell layer is formed on the surface of each composite core in the liquid, a dispersion of toner mother particles is obtained.

The resin particles can be melted to form a film by attaching the resin particles to the surface of each composite core in the liquid and heating the liquid, as described above. However, the resin particles may be formed into a film by being heated in a drying process or receiving physical impact force in a shell external addition process.

Subsequently, the dispersion of the toner mother particles is neutralized using for example sodium hydroxide. Then, the dispersion of the toner mother particles is cooled to for example normal temperature (approximately 25° C.). Subsequently, the dispersion of the toner mother particles is filtrated for example using a Buchner funnel. As a result, the toner mother particles are separated (solid-liquid separated) from the liquid and a wet cake of the toner mother particles is obtained. Subsequently, the toner mother particles are washed for example by dispersing the toner mother particles in water and filtering the resultant dispersion, repeatedly. Subsequently, the washed toner mother particles are dried. The toner mother particles may be dried using for example a spray dryer, a fluidized bed dryer, a vacuum freeze dryer, or a reduced pressure dryer. Thereafter, external addition to the toner mother particles (shell external addition process) may be performed as necessary. In the shell external addition process, the toner mother particles and an external additive (for example, silica particles) are mixed using for example a mixer (specific examples include an FM mixer produced by Nippon Coke & Engineering Co., Ltd.) to cause the external additive to adhere to the surface of each toner mother particle. Note that in a situation in which the spray dryer is used in the drying process, the drying process and the shell external addition process can be performed simultaneously by spraying a dispersion of the external additive (for example, silica particles) to the toner mother particles. Through the above, a toner including a large number of toner particles is produced.

The procedures and order of the processes in the above-described method for producing the toner may be altered as appropriate in accordance with desired structure or properties of the toner. For example, in a situation in which a material (for example, the shell material) is caused to react in a liquid, the material may be caused to react in the liquid for a predetermined time period after being added to the liquid. Alternatively, the material may be caused to react in the liquid while the material is added to the liquid over a long period of time. The shell material may be added to the liquid at one time or in plural times. Furthermore, the toner may be sifted after the external addition process. Note that non-essential processes may be omitted. For example, in a situation in which a commercially available product can be used directly as a material, use of the commercially available product can omit the process of preparing the material. In a situation in which reaction for forming the shell layer progresses favorably even without pH adjustment of the liquid, a process of pH adjustment may be omitted. If an external additive is unnecessary, the shell external addition process may be omitted. In a situation in which an external additive is not attached to the surfaces of the toner mother particles the shell external addition process is omitted), the toner mother particles are equivalent to the toner particles. A prepolymer may be used as necessary instead of a monomer as a material for synthesizing a resin. In order to obtain a specific compound, a salt, ester, hydrate, or anhydride of the compound may be used as a raw material. Preferably, a large number of the toner particles are formed at the same time in order to produce the toner efficiently. The toner particles produced at the same time are thought to have substantially the same structure.

EXAMPLES

The following describes examples of the present disclosure. Table 1 indicates toners (electrostatic latent image developing toners) TA-1 to TA-7 and TB-1 to TB-7 according to examples and comparative examples. Tables 2 and 3 respectively indicate organic particles and thermoplastic resin particles used in production of the toners indicated in Table 1. Note that "Form" in Table 1 indicates a form that organic particles added in the core external addition process take after completion of each toner.

TABLE 1

| Toner | Core external addition: Organic particle | Core external addition: Mixing time [min] | Core external addition: Form | Shell layer formation: Resin particle | Shell external addition: External additive |
|---|---|---|---|---|---|
| TA-1 | A | 5 | Particle | S-1 | Silica particle |
| TA-2 | D | 5 | Particle | S-3 | |
| TA-3 | C | 5 | Particle | S-3 | |
| TA-4 | C | 5 | Particle | S-4 | |
| TA-5 | D | 5 | Particle | S-4 | |
| TA-6 | F | 5 | Particle | S-1 | |
| TA-7 | G | 5 | Particle | S-1 | |
| TB-1 | A | 20 | Film | S-1 | Silica particle |
| TB-2 | A | 5 | Particle | S-2 | |
| TB-3 | A | 5 | Particle | S-5 | |
| TB-4 | B | 5 | Particle | S-1 | |
| TB-5 | E | 5 | Particle | S-1 | |
| TB-6 | H | 5 | Particle | S-1 | |
| TB-7 | Absent | — | — | S-1 | |

TABLE 2

| Organic particle | Internal releasing agent | Tg [° C.] | Particle diameter [nm] | Mw (THF soluble component) |
|---|---|---|---|---|
| A | Ester wax | 101 | 120 | 73000 |
| B | Ester wax | 79 | 120 | 73000 |
| C | Ester wax | 92 | 109 | 70000 |
| D | Ester wax | 109 | 109 | 71000 |
| E | Ester wax | 114 | 108 | 73000 |
| F | Carnauba wax | 102 | 108 | 72000 |
| G | Hydrocarbon wax | 99 | 103 | 74000 |
| H | None | 103 | 115 | 72000 |

TABLE 3

| Thermoplastic resin particle | Tg [° C.] | Particle diameter [nm] | Mw (THF soluble component) |
|---|---|---|---|
| S-1 | 71 | 108 | 72000 |
| S-2 | 40 | 120 | 70000 |
| S-3 | 52 | 130 | 74000 |
| S-4 | 89 | 111 | 74000 |
| S-5 | 103 | 115 | 72000 |

The following describes production methods, evaluation methods, and evaluation results of the toners TA-1 to TA-7 and TB-1 to TB-7 in order. In evaluations in which errors may occur, an arithmetic mean of an appropriate number of measured values was determined to be an evaluation value in order to ensure that any errors were sufficiently small. A glass transition point (Tg), a melting point (Mp), a softening point (Tm), and molecular weights (Mw and Mn) were measured by the following methods, unless otherwise stated.

<Method for Measuring Tg>

A differential scanning calorimeter (DSC-6220 produced by Seiko Instruments Inc.) was used as a measuring device. A glass transition point (Tg) of a sample was determined by plotting a heat absorption curve of the sample using the measuring device. Specifically, about 10 mg of the sample (for example, a resin) was placed in an aluminum pan (aluminum container) and the aluminum pan was set on a measurement section of the measuring device. Also, an empty aluminum pan was used as a reference. In plotting the heat absorption curve, a temperature of the measurement section was increased from 25° C. to 200° C. at a rate of 10° C./min (RUN1). Thereafter, the temperature of the measurement section was decreased from 200° C. to 25° C. at a rate of 10° C./min. Subsequently, the temperature of the measurement section was increased again from 25° C. to 200° C. at a rate of 10° C./min (RUN2). The heat absorption curve (vertical axis: heat flow (DSC signal), horizontal axis: temperature) of the sample was plotted in RUN2. The glass transition point (Tg) of the sample was read from the plotted heat absorption curve. The glass transition point (Tg) of the sample is a temperature (onset temperature) corresponding to a point of change in specific heat on the heat absorption curve (an intersection point of an extrapolation of a baseline and an extrapolation of an inclined portion of the curve).

<Method for Measuring Mp>

A differential scanning calorimeter (DSC-6220 produced by Seiko Instruments Inc.) was used as a measuring device. A melting point (Mp) of a sample was determined by plotting a heat absorption curve of the sample using the measuring device. Specifically, about 15 mg of the sample (for example, a releasing agent or a resin) was placed in an aluminum pan and the aluminum pan was set on a measurement section of the measuring device. Also, an empty aluminum pan was used as a reference. In plotting the heat absorption curve, a temperature of the measurement section was increased from 30° C. to 170° C. at a rate of 10° C./min. The heat absorption curve (vertical axis: heat flow (DSC signal), horizontal axis: temperature) of the sample was plotted while the temperature was increased. The melting point (Mp) of the sample was read from the plotted heat absorption curve. The melting point (Mp) of the sample is a temperature on the heat absorption curve corresponding to a maximum of enthalpy of fusion.

<Method for Measuring Tm>

An S-shaped curve (vertical axis: stroke, horizontal axis: temperature) of a sample (for example, a resin) was plotted by setting the sample in a capillary rheometer (CFT-500D produced by Shimadzu Corporation) and causing melt-flow of 1 $cm^3$ of the sample under conditions of a die pore diameter of 1 mm, a plunger load of 20 $kg/cm^2$, and a heating rate of 6° C./min. Then, a softening point (Tm) of the sample was read from the plotted S-shaped curve. The softening point (Tm) of the sample is a temperature on the S-shaped curve corresponding to a stroke value of "$(S_1+S_2)/2$", where $S_1$ represents a maximum stroke value and $S_2$ represents a baseline stroke value at low temperatures.

<Method for Measuring Molecular Weight>

Molecular weights of a sample (specifically, a THF soluble component of the sample) were measured by gel permeation chromatography (GPC). A gel permeation chromatography (GPC) apparatus (HLC-8220GPC produced by Tosoh Corporation) was used as a measuring device. A polystyrene gel column obtained by combining two columns for organic solvent size exclusion chromatography (SEC) (TSKgel GMHXL produced by Tosoh Corporation, filler: styrene-based polymer, column size: 7.8 mm (inside diameter)×30 cm (length), filler particle diameter: 9 μm) in series was used as a column. A refractive index (RI) detector was used as a detector.

Tetrahydrofuran (THF) was used as a solvent. The sample (resin) was added to THF to achieve a concentration of 3.0 mg/mL and left for one hour to dissolve therein. The resultant THF solution was filtered using a non-aqueous sample pretreatment filter (Chromatodisc 25N produced by Kurabo industries Ltd., filter pore diameter: 0.45 μm) to obtain a measurement sample (THF solution of the sample).

The column was set within a heat chamber of the measuring device. A temperature of the heat chamber was controlled to 40° C. and the column was stabilized within the heart chamber at the temperature of 40° C. Subsequently, the solvent (THF) was passed through the column at the temperature of 40° C. at a flow rate of 1 mL/min, and about 100 μL of the measurement sample (THF solution prepared as above) was introduced into the column. An elution curve (vertical axis: detection intensity (detection count), horizontal axis: elution time) of the sample solution introduced into the column was measured. A GPC molecular weight distribution (consequently, a number average molecular weight (Mn) and a mass average molecular weight (Mw)) of the sample (specifically, a THF soluble component of the sample) was determined based on the elution curve and a calibration curve (a graph indicating a relationship between elution times and logarithmic values of molecular weights of respective standard substances whose molecular weights were known) plotted using the following standard substances.

The calibration curve was plotted using monodispersed polystyrenes (standard substances). The monodispersed polystyrenes used as the standard substances were seven types of standard polystyrenes (produced by Tosoh Corporation) having respective molecular weights of $3.84\times10^6$, $1.09\times10^6$, $3.55\times10^5$, $1.02\times10^5$, $4.39\times10^4$, $9.10\times10^3$, and $2.98\times10^3$.

Method for Producing Toner (Synthesis of Non-Crystalline Polyester Resin)

A 5-L reaction vessel equipped with a thermometer (thermocouple), a dewatering conduit, a nitrogen inlet tube, and a stirrer (stirring impeller) was set in an oil bath and charged with 1575 g of a bisphenol A propylene oxide adduct (BPA-PO), 163 g of a bisphenol A ethylene oxide adduct (BPA-EO), 377 g of a fumaric acid, and 4 g of a catalyst (dibutyl tin oxide). Subsequently, the inside of the reaction vessel was made under a nitrogen atmosphere, and then an internal temperature of the reaction vessel was increased to 220° C. using the oil bath while stirring the vessel contents. The vessel contents were caused to react (specifically, polymerize) with each other for eight hours under the nitrogen atmosphere at the temperature of 220° C. while evaporating water generated as a by-product.

Then, the reaction vessel was depressurized, and the vessel contents were caused to further react (specifically, polymerize) with each other for one hour under a reduced pressure atmosphere (pressure: about 60 mmHg) at the temperature of 220° C. Thereafter, the internal temperature of the reaction vessel was decreased to 210° C., and then 336 g of trimellitic anhydride was added into the reaction vessel. The vessel contents were caused to react with each other under the reduced pressure atmosphere (pressure: about 60 mmHg) at the temperature of 210° C. to obtain a reaction product (a non-crystalline polyester resin) having physical properties described below. After the reaction, the vessel contents were taken out of the reaction vessel and cooled, whereby a non-crystalline polyester resin having a softening point (Tm) of 100° C., a glass transition point (Tg) of 50° C., a mass average molecular weight (Mw) of 30000, an acid value (AV) of 15 mgKOH/g, and a hydroxyl value (OHV) of 30 mgKOH/g was obtained.

(Synthesis of Crystalline Polyester Resin)

A 5-L reaction vessel equipped with a thermometer (thermocouple), a dewatering conduit, a nitrogen inlet tube, and a stirrer (stirring impeller) was set in an oil bath and charged with 132 g of 1,6-hexanediol, 230 g of 1,10-decanedicarboxylic acid, 0.3 g of 1,4-benzenediol, and 1 g of a catalyst (dibutyl tin oxide). Subsequently, the inside of the reaction vessel was made under a nitrogen atmosphere, and then an internal temperature of the reaction vessel was increased to 200° C. using the oil bath while stirring the vessel contents. The vessel contents were caused to react (specifically, polymerize) with each other for five hours under the nitrogen atmosphere at the temperature of 200° C. while evaporating water generated as a by-product.

Subsequently, the reaction vessel was depressurized, and the vessel contents were caused to react with each other under a reduced pressure atmosphere (pressure: about 12 mmHg) at the temperature of 200° C. to obtain a reaction product (a crystalline polyester resin) having physical properties described below. After the reaction, the vessel contents were taken out of the reaction vessel and cooled, whereby a crystalline polyester resin having a softening point (Tm) of 80° C., a melting point (Mp) of 70° C., a crystallinity index of 1.14, an acid value (AV) of 3.6 mgKOH/g, a hydroxyl value (OHV) of 18 mgKOH/g was obtained.

(Production of Toner Cores)

Initially, 86 parts by mass of the non-crystalline polyester resin obtained as above, 15 parts by mass of the crystalline polyester resin obtained as above, 5 parts by mass of a colorant (carbon black: MA-100 produced by Mitsubishi Chemical Corporation), and 5 parts by mass of a releasing agent (synthetic ester wax: NISSAN ELECTOL (registered Japanese trademark) WEP-3 produced by NOF Corporation, melting point: 73° C.) were mixed using an FM mixer (produced by Nippon Coke & Engineering Co., Ltd.).

Subsequently, the resultant mixture was melt-kneaded using a twin-screw extruder (PCM-30 produced by Ikegai Corp.). Thereafter, the resultant melt-kneaded product was cooled. Subsequently, the cooled melt-kneaded product was pulverized using a mechanical pulverizer (Turbo Mill produced by Freund-Turbo Corporation). Subsequently, the resultant pulverized product was classified using a classifier (Elbow Jet EJ-LABO type produced by Nittetsu Mining Co., Ltd.). As a result, toner cores having a volume median diameter ($D_{50}$) of 6 μm, a triboelectric charge with a standard carrier of −20 μC:/g, and a zeta potential at pH 4 of −30 mV were obtained. The triboelectric charge with the standard carrier and the zeta potential at pH 4 were measured by respective methods described below.

<Method for Measuring Triboelectric Charge:>

Initially, 100 parts by mass of a standard carrier N-01 (standard carrier for a negatively chargeable toner) provided by The Imaging Society of Japan and 7 parts by mass of a sample (toner cores) were mixed for 30 minutes using a mixer (TURBULA (registered Japanese trademark) Mixer T2F produced by Willy A. Bachofen (WAB) AG) at a rotational speed of 96 rpm. Subsequently, a triboelectric charge of the sample in the resultant mixture was measured using a Q/m meter (MODEL 210HS-2A produced by TREK, INC.). Specifically, 0.10 g of the mixture (the standard carrier and the sample) was placed in a measurement cell of the Q/m meter, and only the sample (toner cores) in the mixture was sucked through a sieve (wire netting) for ten seconds. Then, a charge amount (unit: μC/g) of the sample (toner cores) was calculated based on an expression "total electric amount (unit: μC) of sucked sample/mass (unit: g) of sucked sample".

<Method for Measuring Zeta Potential>

Initially, 0.2 g of a sample (toner cores), 80 g of ion exchanged water, and 20 g of a nonionic surfactant (K-8.5 produced by Nippon Shokubai Co., Ltd., component: polyvinylpyrrolidone) having a concentration of 1% by mass were mixed using a magnetic stirrer. Subsequently, the sample was dispersed uniformly in the liquid to obtain a dispersion. Subsequently, a pH of the dispersion was adjusted to 4 by adding a dilute hydrochloric acid to the dispersion. A zeta potential of the sample (toner cores) in the dispersion at a temperature of 25° C. and pH 4 was measured by electrophoresis (more specifically, laser Doppler electrophoresis) using a zeta potential and particle size distribution analyzer (Delsa Nano HC produced by Beckman Coulter, Inc.).

(Production of Organic Particles A)

(Production of Organic Particles A: Preparation of Wax Dispersion)

A high-pressure shear emulsification device (CLEARMIX (registered Japanese trademark) CLM-2.25 produced by M Technique Co., Ltd.) was charged with 80 parts by mass of ion exchanged water at a temperature of 80° C., 20 parts by mass of a synthetic ester wax (NISSAN ELECTOL WEP-3 produced by NOF Corporation, melting point: 73° C.), sodium dodecylbenzenesulfonate, and poly(oxyethylene) nonyl phenyl ether. The above materials were emulsified using the high-pressure shear emulsification device. As a result, a wax dispersion containing ester wax particles was obtained. The ester wax particles contained in the wax dispersion had a number average primary particle diameter of 420 nm. The number average primary particle diameter was measured using a laser diffraction/scattering particle size distribution analyzer (LA-950V2 produced by Horiba, Ltd.).

(Production of Organic Particles A: Resin Synthesis Process)

A reaction vessel (capacity: 2 L, inside diameter: 120 mm) equipped with a thermometer (thermocouple), a dewatering conduit, a nitrogen inlet tube, and a stirrer (stirring impeller: three sweptback blades) was set in an oil bath and charged with 35 parts by mass of the wax dispersion obtained as above and 328 parts by mass of ion exchanged water. Subsequently, a temperature of the vessel contents was increased to 80° C. using the oil bath while introducing nitrogen into the reaction vessel. Thereafter, 6.4 parts by mass of an aqueous solution of hydrogen peroxide having a concentration of 2% by mass and 6.4 parts by mass of an aqueous solution of ascorbic acid having a concentration of 2% by mass were added into the reaction vessel.

Subsequently, dropping of three types of liquids (a first liquid, a second liquid, and a third liquid) into the reaction vessel was simultaneously started under the nitrogen atmosphere at the temperature of 80° C. The three types of liquids were each dropped into the reaction vessel at a constant rate. Specifically, 90.0 parts by mass of the first liquid described below was dropped for five hours, 25.8 parts by mass of the second liquid described below was dropped for five hours, and 72.0 parts by mass of the third liquid described below was dropped for six hours. The first liquid was a mixed liquid of styrene, n-butyl acrylate, and acrylic acid (mass ratio: styrene/n-butyl acrylate/acrylic acid=90.1/7.9/2.0). The second liquid was a mixed liquid of 2.7 parts by mass of an aqueous solution of sodium dodecylbenzenesulfonate having a concentration of 10% by mass, 1.1 parts by mass of an aqueous solution of poly(oxyethylene) nonyl phenyl ether having a concentration of 1% by mass, and 22.0 parts by mass of ion exchanged water. The third liquid was a mixed liquid of 36 parts by mass of an aqueous solution of hydrogen peroxide having a concentration of 2% by mass and 36 parts by mass of an aqueous solution of ascorbic acid having a concentration of 2% by mass.

Subsequently, the vessel contents were further kept under the nitrogen atmosphere at the temperature of 80° C. for 30 minutes to react (specifically, polymerize) with each other. Thereafter, the vessel contents were cooled to yield a milky white dispersion containing a polymer. Subsequently, the dispersion was dried under a reduced pressure to obtain organic particles A (powder).

(Production of Organic Particles B)

Organic particles B (powder) were produced in the same manner as the organic particles A except that a mixed liquid of styrene, n-butyl acrylate, and acrylic acid (mass ratio: styrene/n-butyl acrylate/acrylic acid=82.9/15.1/2.0) was used as the first liquid in the resin synthesis process instead of the mixed liquid of styrene, n-butyl acrylate, and acrylic acid (mass ratio: styrene/n-butyl acrylate/acrylic acid=90.1/7.9/2.0).

(Production of Organic Particles C)

Organic particles C (powder) were produced in the same manner as the organic particles A except that a mixed liquid of styrene, n-butyl acrylate, and acrylic acid (mass ratio: styrene/n-butyl acrylate/acrylic acid=86.2/11.8/2.0) was used as the first liquid in the resin synthesis process instead of the mixed liquid of styrene, n-butyl acrylate, and acrylic acid (mass ratio: styrene/n-butyl acrylate/acrylic acid=90.1/7.9/2.0).

(Production of Organic Particles D)

Organic particles D (powder) were produced in the same manner as the organic particles A except that a mixed liquid of styrene, n-butyl acrylate, and acrylic acid (mass ratio: styrene/n-butyl acrylate/acrylic acid=95.8/2.2/2.0) was used as the first liquid in the resin synthesis process instead of the mixed liquid of styrene, n-butyl acrylate, and acrylic acid (mass ratio: styrene/n-butyl acrylate/acrylic acid=90.1/7.9/2.0).

(Production of Organic Particles E)

Organic particles E (powder reduced in the same manner as the organic particles A except that a mixed liquid of styrene and acrylic acid (mass ratio: styrene/acrylic acid=98.0/2.0) was used as the first liquid in the resin synthesis process instead of the mixed liquid of styrene, n-butyl acrylate, and acrylic acid (mass ratio: styrene/n-butyl acrylate/acrylic acid=90.1/7.9/2.0).

(Production of Organic Particles F)

Organic particles F (powder) were produced in the same manner as the organic particles A except that 20 parts by mass of a carnauba wax (Carnauba Wax No. 1 produced by S. Kato & Co., melting point: 77° C.) was used in the preparation of the wax dispersion instead of 20 parts by mass of the ester wax (NISSAN ELECTOL WEP-3). Carnauba wax particles contained in a wax dispersion obtained by emulsification had a number average primary particle diameter of 380 nm. The number average primary particle diameter was measured using a laser diffraction/scattering particle size distribution analyzer (LA-950V2 produced by Horiba, Ltd.).

(Production of Organic Particles G)

Initially, 90 parts by mass of a mixed liquid of styrene, n-butyl acrylate, and acrylic acid (mass ratio: styrene/n-butyl acrylate/acrylic acid=90/8/2) and 10 parts by mass of a hydrocarbon wax (microcrystalline wax: HNP-9 produced by Nippon Seiro Co., Ltd., melting point: 75° C.) were mixed within a vessel to dissolve the wax. Subsequently, the vessel contents were emulsified by adding sodium dodecylbenzenesulfonate into the vessel while stirring the vessel contents. Subsequently, the vessel contents were emulsion polymerized by adding a polymerization initiator (hydrogen peroxide) into the vessel. As a result, a latex (solid concentration: 20% by mass) including hydrocarbon wax-containing resin particles was obtained. Subsequently, the obtained latex was dried under a reduced pressure to obtain organic particles G (powder).

(Production of Organic Particles H)

Organic particles H (powder) were produced in the same manner as the organic particles A except that the wax dispersion was not added in the resin synthesis process. The wax dispersion was not prepared in the production of the organic particles H.

Table 2 indicates results of measurement of a glass transition point (Tg), a particle diameter (number average primary particle diameter), and a mass average molecular weight (Mw) of each of the organic particles A to H obtained as above. The number average primary particle diameter was measured using a laser diffraction/scattering particle size distribution analyzer (LA-950V2 produced by Horiba, Ltd.). The glass transition point (Tg) was measured by differential scanning calorimetry described above. The mass average molecular weight (Mw) (specifically, Mw of a THF soluble component) was measured by GPC described above. The organic particles A to E each contained a releasing agent (synthetic ester wax). The organic particles F contained a releasing agent (carnauba wax). The organic particles G contained a releasing agent (hydrocarbon wax). The organic particles H contained no releasing agent.

(Production of Thermoplastic Resin Particles S-1)

A reaction vessel (capacity: 2 L, inside diameter: 120 mm) equipped with a thermometer (thermocouple), a dewatering conduit, a nitrogen inlet tube, and a stirrer (stirring impeller: three sweptback blades) was set in an oil bath and charged with 328 parts by mass of ion exchanged water. Subsequently, a temperature of the vessel contents was increased to 80° C. using the oil bath while introducing nitrogen into the reaction vessel. Thereafter, 6.4 parts by mass of an aqueous solution of hydrogen peroxide having a concentration of 2% by mass and 6.4 parts by mass of an aqueous solution of ascorbic acid having a concentration of 2% by mass were added into the reaction vessel.

Subsequently, dropping of three types of liquids (a first liquid, a second liquid, and a third liquid) into the reaction vessel was simultaneously started under the nitrogen atmosphere at the temperature of 80° C. The three types of liquids were each dropped into the reaction vessel at a constant rate. Specifically, 90.0 parts by mass of the first liquid described below was dropped for five hours, 25.8 parts by mass of the second liquid described below was dropped for five hours, and 72.0 parts by mass of the third liquid described below was dropped for six hours. The first liquid was a mixed liquid of styrene, n-butyl acrylate, and acrylic acid (mass ratio: styrene/n-butyl acrylate/acrylic acid=79.2/18.8/2.0). The second liquid was a mixed liquid of 2.7 parts by mass of an aqueous solution of sodium dodecylbenzenesulfonate having a concentration of 10% by mass, 1.1 parts by mass of an aqueous solution of poly(oxyethylene) nonyl phenyl ether having a concentration of 1% by mass, and 22.0 parts by mass of ion exchanged water. The third liquid was a mixed liquid of 36 parts by mass of an aqueous solution of hydrogen peroxide having a concentration of 2% by mass and 36 parts by mass of an aqueous solution of ascorbic acid having a concentration of 2% by mass.

Subsequently, the vessel contents were further kept under the nitrogen atmosphere at the temperature of 80° C. for 30 minutes to react (specifically, polymerize) with each other. Thereafter, the vessel contents were cooled to yield a milky white dispersion containing a polymer. Subsequently, the dispersion was dried under a reduced pressure to obtain thermoplastic resin particles S-1 (powder).

(Production of Thermoplastic Resin Particles S-2)

Thermoplastic resin particles S-2 (powder) were produced in the same manner as the thermoplastic resin particles S-1 except that a mixed liquid of styrene, n-butyl acrylate, and acrylic acid (mass ratio: styrene/n-butyl acrylate/acrylic acid=60.1/37.9/2.0) was used as the first liquid instead of the mixed liquid of styrene, n-butyl acrylate, and acrylic acid (mass ratio: styrene/n-butyl acrylate/acrylic acid=79.2/18.8/2.0).

(Production of Thermoplastic Resin Particles S-3)

Thermoplastic resin particles S-3 (powder) were produced in the same manner as the thermoplastic resin particles S-1 except that a mixed liquid of styrene, n-butyl acrylate, and acrylic acid (mass ratio: styrene/n-butyl acrylate/acrylic acid=67.4/30.6/2.0) was used as the first liquid instead of the mixed liquid of styrene, n-butyl acrylate, and acrylic acid (mass ratio: styrene/n-butyl acrylate/acrylic acid=79.2/18.8/2.0).

(Production of Thermoplastic Resin Particles S-4)

Thermoplastic resin particles S-4 (powder) were produced in the same manner as the thermoplastic resin particles S-1 except that a mixed liquid of styrene, n-butyl acrylate, and acrylic acid (mass ratio: styrene/n-butyl acrylate/acrylic acid 86.2/11.8/2.0) was used as the first liquid instead of the mixed liquid of styrene, n-butyl acrylate, and acrylic acid (mass ratio: styrene/n-butyl acrylate/acrylic acid 79.2/18.8/2.0).

(Production of Thermoplastic Resin Particles S-5)

Thermoplastic resin particles S-5 (powder) were produced in the same manner as the thermoplastic resin particles S-1 except that a mixed liquid of styrene, n-butyl acrylate, and acrylic acid (mass ratio: styrene/n-butyl acrylate/acrylic acid=90.1/7.9/2.0) was used as the first liquid instead of the mixed liquid of styrene, n-butyl acrylate, and acrylic acid (mass ratio: styrene/n-butyl acrylate/acrylic acid 79.2/18.8/2.0).

Table 3 indicates results of measurement of a glass transition point (Tg), a particle diameter (number average primary particle diameter), and a mass average molecular weight (Mw) of each of the thermoplastic resin particles S-1 to S-5 obtained as above. The number average primary particle diameter was measured using a laser diffraction/scattering particle size distribution analyzer (LA-950V2 produced by Horiba, Ltd.). The glass transition point (Tg) was measured by differential scanning calorimetry described above. The mass average molecular weight (Mw) (specifically, Mw of a THF soluble component) was measured by GPC described above. None of the thermoplastic resin particles S-1 to S-5 contained a releasing agent.

(Core External Addition)

An FM mixer (FM-10B produced by Nippon Coke & Engineering Co., Ltd., upper blade: Y1 blade for high circulation, lower blade: S0 blade for high circulation and high pressure) was used to mix 100 parts by mass of the toner cores prepared as above and 5 parts by mass of organic particles (any of the organic particles A to G specified for each toner as indicated in Table 1) at a frequency of 57 Hz and a jacket temperature of 20° C. for a specific time period (mixing time specified for each toner as indicated in Table 1). For example, the toner cores and the organic particles A were mixed for five minutes in production of the toner TA-1. The toner cores and the organic particles A were mixed for 20 minutes in production of the toner TB-1. The above external addition (mixing of the toner cores and the organic particles) corresponds to "Core External Addition" in Table 1. The core external addition was not performed in production of the toner TB-7. In production of the toners TA-1 to TA-7 and TB-1 to TB-6, the organic particles (any of the organic particles A to G) adhered to the surface of each toner core by the above mixing. As a result, toner cores (composite cores) with the organic particles adhering to surfaces thereof were obtained.

(Formation of Shell Layer)

A 1-L three-necked flask equipped with a thermometer and a stirring impeller was set in a water bath. Subsequently, the flask was charged with 300 mL of ion exchanged water, and an internal temperature of the flask was kept at 30° C. using the water bath. Subsequently, a pH of the flask contents was adjusted to 4 by adding a dilute hydrochloric acid to the flask contents.

Subsequently, 4 mL of thermoplastic resin particles (any of the thermoplastic resin particles S-1 to S-5 specified for each toner as indicated in Table 1) were added into the flask. For example, the thermoplastic resin particles S-1 were added in the production of the toner TA-1.

Subsequently, 300 g of the composite cores obtained as above (or the toner cores in the production of the toner TB-7) were added into the flask, and the flask contents were stirred for one hour at a rotational speed of 200 rpm and a temperature of 30° C. Subsequently, 300 mL of ion exchanged water was added into the flask, and an internal temperature of the flask was increased to 70° C. at a rate of 1° C./min while stirring the flask contents at a rotational speed of 100 rpm. Subsequently, the flask contents were stifled for two hours at the temperature of 70° C. and the rotational speed of 100 rpm. Through the above, the thermoplastic resin particles (specifically, any of the thermoplastic resin particles S-1 to S-5) bonded to the surface of each composite core (each toner core in the production of the toner TB-7). The thermoplastic resin particles S-1 to S-3 were each formed into a film while the internal temperature of the flask was kept at the high temperature (70° C.). By contrast, the thermoplastic resin particles S-4 and S-5 remained in the form of particles with almost no deformation. As a result of the above heating (temperature: 70° C., retention time: 2 hours), a shell layer was formed on the surface of each composite core (or each toner core in the production of the toner TB-7) in the liquid to yield a dispersion of toner mother particles.

Subsequently, a pH of the dispersion of the toner mother particles was adjusted to (neutralized)using sodium hydroxide, and the dispersion of the toner mother particles was cooled to normal temperature (approximately 25° C.), (Washing Process)

The dispersion of the toner mother particles obtained as above was filtered (subjected to solid-liquid separation) using a Buchner funnel. As a result, a wet cake of the toner mother particles was obtained. Thereafter, the toner mother particles in the form of a wet cake were redispersed in ion exchanged water. Dispersion and filtration were further repeated five times to wash the toner mother particles. In the production of the toner TA-1, an amount of filtrate after the washing was 97 parts by mass relative to 100 parts by mass of toner mother particles (dry toner mother particles) obtained through a drying process described below. In the production of the toner TA-1, a total organic carbon (TOC) concentration of the filtrate after the washing was not higher than 8 mg/L. The TOC concentration was measured using an online TOC analyzer (TOC-4200 produced by Shimadzu Corporation, oxidation method: 680° C. combustion catalyst oxidation, detection method: NDIR method).

(Drying Process)

Subsequently, the washed toner mother particles (powder) were dispersed in an aqueous solution of ethanol having a concentration of 50% by mass to obtain slurry of the toner mother particles. Subsequently, the toner mother particles in the slurry were dried using a continuous type surface modifier (Coatmizer (registered Japanese trademark) produced by Freund Corporation) at a hot air temperature of 45° C. and a blower flow rate of 2 $m^3$/min. As a result, dry toner mother particles (powder) were obtained.

(Shell External Addition)

Subsequently, 100 parts by mass of the toner mother particles obtained as above and 1.0 part by mass of dry silica particles (AEROSIL (registered Japanese trademark) REA90 produced by Nippon Aerosil Co., Ltd.) were mixed for five minutes using a 10-L FM mixer (produced by Nippon Coke & Engineering Co., Ltd.) at a rotational speed of 3000 rpm and a jacket temperature of 20° C. Through the above, an external additive was attached to the surface of each toner mother particle. Thereafter, sifting was performed using a 200 mesh sieve (opening: 75 μm). Through the above, the toners (toners TA-1 to TA-7 and TB-1 to TB-7) each including a large number of toner particles were obtained.

[Evaluation Methods]

Samples (the toners TA-1 to TA-7 and TB-1 to TB-7) were each evaluated by methods described below.

(High-Temperature Preservability)

Initially, 2 g of a sample (toner) was put in a 20-mL polyethylene container, and the container was left in a thermostatic chamber set to 55° C. for three hours. Thereafter, the toner was taken out of the thermostatic chamber and cooled to room temperature (approximately 25° C.) to obtain an evaluation toner.

Subsequently, the obtained evaluation toner was placed on a 200 mesh sieve (opening: 75 μm) whose mass was known. A mass of the toner prior to sifting was calculated by measuring a total mass of the sieve and the toner. Subsequently, the sieve was set in a powder tester (produced by Hosokawa Micron Corporation) and caused to vibrate in accordance with a manual of the powder tester at a rheostat level of 5 for 30 seconds in order to sift the toner. A mass of the toner remaining on the sieve after the shifting was calculated by measuring a total mass of the sieve and the toner. A degree of aggregation (unit: % by mass) was calculated from the mass of the toner prior to the sifting and the mass of the toner after the sifting (mass of the toner remaining on the sieve after the sifting) based on the following equation.

$$\text{Degree of aggregation} = 100 \times (\text{mass of toner after sifting})/(\text{mass of toner prior to sifting})$$

High-temperature preservability of a toner having a degree of aggregation of no greater than 10% by mass was evaluated as G (good). High-temperature preservability of a toner having a degree of aggregation of greater than 10% by mass was evaluated as B (bad).

(Fixability)

A two-component developer was prepared by mixing 100 parts by mass of a developer carrier (carrier for FS-C5250DN) and 5 parts by mass of a sample (toner) for 30 minutes using a ball mill.

A lowest fixing temperature and a width of a fixing temperature range (fixing OW: fixing operation window) were evaluated by forming an image using the two-component developer prepared as above. A color printer (FS-C5250DN produced by KYOCERA Document Solutions Inc.) equipped with a roller-roller type heat and pressure fixing device (nip width: 8 mm) was modified so as to be capable of changing the fixing temperature for use as an evaluation apparatus. The two-component developer prepared as above was loaded into a developing device of the evaluation apparatus, and the sample (toner for replenishment use) was loaded into a toner container of the evaluation apparatus.

A solid image specifically, unfixed toner image) having a size of 25 mm×25 mm was formed on paper $C^2$90 produced by Fuji Xerox Co., Ltd., plain paper of A4 size having a basis weight of 90 g/$m^2$) using the evaluation apparatus under conditions of a linear speed of 200 mm/s and a toner application amount of 1.0 mg/$cm^2$ in an environment at a temperature of 23° C. and a relative humidity of 55%. Subsequently, the paper with the image formed thereon was passed through the fixing device of the evaluation apparatus. The nip passage time was 40 milliseconds.

In the evaluation of the lowest fixing temperature, the fixing temperature was set within a range from 100° C. to 200° C. The fixing temperature of the fixing device was gradually increased from 100° C. to determine a lowest temperature (lowest fixing temperature) at which the solid image (toner image) was fixed to the paper and a highest temperature (highest fixing temperature) at which offset did not occur.

In the determination of the lowest fixing temperature, whether or not a toner was fixed was checked by a fold-rubbing test described below. Specifically, the fold-rubbing test was performed by folding evaluation paper that had been passed through the fixing device in half such that a surface on which the image was formed was folded inwards, and rubbing a 1-kg weight covered with cloth back and forth on the image on the fold ten times. Then, the paper was unfolded and the folded portion of the paper (portion in which the solid image was formed) was observed. A length of toner peeling (peeling length) in the folded portion was measured. The lowest temperature among fixing temperatures for which the peeling length was no greater than 1 mm was determined to be the lowest fixing temperature. A lowest fixing temperature no greater than 130° C. was evaluated as G (good), and a lowest fixing temperature greater than 130° C. was evaluated as B (bad).

In the determination of the highest fixing temperature, evaluation paper that had been passed through the fixing device was visually observed to check whether or not offset occurred (whether or not the toner adhered to a fixing roller). The width of the fixing temperature range (fixing OW) was calculated based on an equation "Fixing OW=(highest fixing temperature)−(lowest fixing temperature)". A width of the fixing temperature range of at least 40° C. was evaluated as G (good), and a width of the fixing temperature range of smaller than 40° C. was evaluated as B (bad).

(Initial Charge Amount and Initial Image Density)

An evaluation developer was obtained by mixing 100 parts by mass of a developer carrier (carrier for FS-C5300DN produced by KYOCERA Document Solutions Inc.) and 10 parts by mass of a sample (toner) for 30 minutes using a ball mill. Subsequently, the evaluation developer was left in an environment of high temperature and high humidity (temperature: 32.5° C., relative humidity: 80%) for 24 hours. Thereafter, a charge amount of the toner in the evaluation developer was measured using a Q/m meter (MODEL 210HS-2A produced by TREK, INC.) under the following conditions.

<Method for Measuring Charge Amount of Toner in Developer>

First, 0.10 g of the developer (the carrier and the toner) was placed in a measurement cell of the Q/m meter, and only the toner in the developer was sucked through a sieve (wire netting) for 10 seconds. A charge amount (unit: μC/g) of the toner in the developer was calculated based on an expression "total electric amount (unit: μC) of sucked toner/mass (unit: g) of sucked toner".

A charge amount of at least 15 μC/g and no greater than 25 μC/g was evaluated as G (good), and a charge amount of less than 15 μC/g or greater than 25 μC/g was evaluated as B (bad).

Further, an image was formed using the evaluation developer prepared as above, and an image density (ID) of the formed image was measured. A color printer (FS-C5300DN produced by KYOCERA Document Solutions Inc.) was used as an evaluation apparatus. The evaluation developer prepared as above was loaded into a developing device of the evaluation apparatus, and the sample (toner for replenishment use) was loaded into a toner container of the evaluation apparatus. A sample image including a solid portion and a blank portion was formed on a recording medium (evaluation paper) using the evaluation apparatus in an environment of high temperature and high humidity (temperature: 32.5° C., relative humidity: 80%). An image density (ID) of the solid portion of the image formed on the recording medium was measured using a reflectance densitometer (SpectroEye (registered Japanese trademark) produced by X-Rite Inc.).

An image density (ID) of at least 1.30 was evaluated as G good), and an image density (ID) of less than 1.30 was evaluated as B (bad).

(Charge Amount and Image Density After Printing Durability Test)

A printing durability test was performed by continuously performing printing on 10000 sheets at a coverage rate of 5% in an environment of high temperature and high humidity (temperature: 32.5° C., relative humidity: 80%) using the same evaluation apparatus as that used for the evaluation of the initial charge amount and the initial image density. After the printing durability test, the developer was taken out of the developing device of the evaluation apparatus, and a charge amount of the toner in the developer was measured. Also, after the printing durability test, a sample image including a solid portion and a blank portion was formed on a recording medium (evaluation paper) using the evaluation apparatus in an environment of high temperature and high humidity (temperature: 32.5° C., relative humidity: 80%), and an image density (ID) of the formed image was measured. The charge amount and the image density (ID) were measured and evaluated in the same manner as the measurement and evaluation of the initial charge amount and the initial image density.

[Evaluation Results]

Table 4 indicates evaluation results of each of the toners TA-1 to TA-7 and TB-1 to TB-7. Table 4 indicates measured values of fixability (the lowest fixing temperature and the width of the fixing temperature range (fixing OW)), charge amounts (the initial charge amount of the toner and the charge amount of the toner after the printing durability test), ID (the initial image density and the image density after the printing durability test), and high-temperature preservability (the degree of aggregation)

TABLE 4

| | | Fixability [° C.] | | Initial Charge | | After printing durability test Charge | | High-temperature |
|---|---|---|---|---|---|---|---|---|
| | Toner | Lowest | Fixing OW | amount [μC/g] | ID | amount [μC/g] | ID | preservability [% by mass] |
| Example 1 | TA-1 | 125 | 49 | 22 | 1.37 | 21 | 1.39 | 5 |
| Example 2 | TA-2 | 122 | 55 | 18 | 1.43 | 17 | 1.41 | 8 |
| Example 3 | TA-3 | 124 | 45 | 22 | 1.38 | 20 | 1.36 | 10 |
| Example 4 | TA-4 | 129 | 41 | 20 | 1.41 | 20 | 1.41 | 3 |
| Example 5 | TA-5 | 128 | 53 | 22 | 1.39 | 22 | 1.36 | 3 |
| Example 6 | TA-6 | 126 | 49 | 17 | 1.44 | 16 | 1.46 | 4 |
| Example 7 | TA-7 | 125 | 46 | 25 | 1.33 | 24 | 1.32 | 5 |
| Comparative example 1 | TB-1 | 134 (B) | 54 | 16 | 1.48 | 12 (B) | 1.49 | 25 (B) |
| Comparative example 2 | TB-2 | 125 | 45 | 20 | 1.40 | 18 | 1.44 | 40 (B) |
| Comparative example 3 | TB-3 | 137 (B) | 50 | 22 | 1.38 | 24 | 1.33 | 2 |
| Comparative example 4 | TB-4 | 124 | 37 (B) | 21 | 1.42 | 20 | 1.43 | 9 |
| Comparative example 5 | TB-5 | 135 (B) | 53 | 21 | 1.40 | 19 | 1.38 | 3 |
| Comparative example 6 | TB-6 | 128 | 30 (B) | 20 | 1.41 | 23 | 1.37 | 5 |
| Comparative example 7 | TB-7 | 118 | 20 (B) | 11 (B) | 1.50 | 10 (B) | 1.52 | 80 (B) |

The toners TA-1 to TA-7 (toners according to first through seventh examples) each had the above-described basic features. Specifically, the toners TA-1 to TA-7 each included a plurality of toner particles each including a composite core (specifically, a composite of a toner core and a plurality of organic particles adhering to a surface of the toner core) and a shell layer (see Table 1). The shell layer contained a first resin having a glass transition point of at least 50° C. and no greater than 90° C. (see Tables 1 and 3). The organic particles each contained a releasing agent and a second resin having a glass transition point of at least 90° C. and no greater than 110° C. (see Tables 1 and 2).

A surface of the shell layer in each of the toners TA-1 and TA-7 had raised regions corresponding to the organic particles of the composite core. Through observation of a cross section of a toner particle using a transmission electron microscope (TEM), it was found that a number average primary particle diameter of the organic particles was the same as that at the time of addition thereof (see Table 2). No releasing agent was contained inside the shell layer. The shell layer in each of the toners TA-1 to TA-3. TA-6, and TA-7 had a thickness of about 40 nm. The shell layer in each of the toilers TA-4 and TA-5 had a thickness of about 100 nm. The shell layer in each of the toners TA-1 to TA-3, TA-6, and TA-7 covered about 90% of a surface area of each toner core. The shell layer in each of the toners TA-4 and TA-5 covered about 60% of a surface area of each toner core.

As indicated in Table 4, the toilers TA-1 to TA-7 (toners according to the first through seventh examples) were excellent in fixability (low-temperature fixability and hot offset resistance), chargeability (initial chargeability and chargeability after the printing durability test), and high-temperature preservability. Also, high-quality images were formed using the toners TA-1 to TA-7 both in the evaluation of the initial image density and the evaluation of the image density after the printing durability test.

Through observation of a cross section of a toner particle included in the toner TB-1 (toner according to a first comparative example) using a transmission electron microscope (TEM), it was found that the organic particles A were melted to form of a film. The toner TB-1 was inferior to the toners TA-1 to TA-7 in low-temperature fixability, chargeability (chargeability after the printing durability test), and high-temperature preservability.

An amount of a releasing agent contained in the toner cores of each of the toners TA-1 to TA-7 and TB-1 to TB-7 was 5 parts by mass relative to 100 parts by mass of a binder resin (85 parts by mass of a non-crystalline polyester resin and 15 parts by mass of a crystalline polyester resin). However, even when the amount of the releasing agent was reduced from 5 parts by mass to 1 part by mass in the production of each of the toners TA-1 to TA-7 and TB-1 to TB-7, evaluation results of each of the toners showed a tendency substantially the same as that indicated in Table 4. That is, toners having the above-described basic features were superior to toners that did not have the basic features in fixability, charge amount, ID (image density), and high-temperature preservability. However, a width of the fixing temperature range (fixing OW) of each of the toners became smaller than that indicated in Table 4.

What is claimed is:

1. An electrostatic latent image developing toner comprising a plurality of toner particles each including a composite core and a shell layer covering a surface of the composite core, wherein the composite core is a composite of a toner core and a plurality of organic particles adhering to a surface of the toner core, the shell layer contains a first resin having a glass transition point of at least 50° C. and no greater than 90° C., and the organic particles each contain a releasing agent and a second resin having a glass transition point of at least 90° C. and no greater than 110° C.

2. The electrostatic latent image developing toner according to claim 1, wherein the shell layer is a film that contains a thermoplastic resin as the first resin, and no releasing agent is contained inside the film.

3. The electrostatic latent image developing toner according to claim 2, wherein the organic particles are present at an interface between the toner core and the shell layer, and a surface of the shell layer has raised regions at positions corresponding to the organic particles.

4. The electrostatic latent image developing toner according to claim 3, wherein the shell layer has a thickness of at least 20 nm and no greater than 70 nm, and the organic particles have a number average primary particle diameter of at least 80 nm and no greater than 150 nm.

5. The electrostatic latent image developing toner according to claim 3, wherein the shell layer covers an entire surface area of the composite core.

6. The electrostatic latent image developing toner according to claim 1, wherein the organic particles each contain, as the second resin, a polymer of monomers including at least one styrene-based monomer, at least one (meth)acrylic acid ester, and at least one (meth)acrylic acid.

7. The electrostatic latent image developing toner according to claim 6, wherein the organic particles each contain, as the releasing agent, at least one releasing agent selected from the group consisting of ester waxes and hydrocarbon waxes.

8. The electrostatic latent image developing toner according to claim 6, wherein the shell layer contains, as the first resin, a polymer of monomers including at least one styrene-based monomer, at least one (meth)acrylic acid ester, and at least one (meth)acrylic acid.

9. The electrostatic latent image developing toner according to claim 8, wherein the toner core contains a melt-kneaded product of a non-crystalline polyester resin, a crystalline polyester resin, and an internal additive.

10. The electrostatic latent image developing toner according to claim 9, wherein the organic particles each adhere to the surface of the toner core mainly by Van de Waals three.

11. The electrostatic latent image developing toner according to claim 9, wherein a zeta potential of the toner core at pH 4 is no greater than −10 mV.

12. The electrostatic latent image developing toner according to claim 1, wherein the toner core contains a non-crystalline polyester resin and a crystalline polyester resin, the organic particles each contain, as the releasing agent, at least one releasing agent selected from the group consisting of ester waxes and hydrocarbon waxes, the first resin contained in the shell layer is a polymer of at least 62% by mass and no greater than 88% by mass of a styrene-based monomer, at least 10% by mass and no greater than 33% by mass of a (meth)acrylic acid ester, and at least 2% by mass and no greater than 5% by mass of a (meth)acrylic acid, and the second resin contained in the organic particles is a polymer of at least 86% by mass and no greater than 96% by mass of a styrene-based monomer, at least 2% by mass and no greater than 7% by mass of a (meth) acrylic acid ester, and at least 2% by mass and no greater than 7% by mass of a (meth)acrylic acid.

* * * * *